US009229400B2

(12) United States Patent
Ito et al.

(10) Patent No.: US 9,229,400 B2
(45) Date of Patent: Jan. 5, 2016

(54) IMAGE FORMING APPARATUS HAVING A POWER SUPPLY COMMON TO PRIMARY TRANSFER AND SECONDARY TRANSFER

(75) Inventors: Yoshikuni Ito, Tokyo (JP); Yasuhiro Horiguchi, Tokyo (JP); Takayuki Tanaka, Yokohama (JP); Kenji Karashima, Tokyo (JP); Satoshi Tsuruya, Mishima (JP); Shinichi Nishida, Kawasaki (JP); Takeshi Fujino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/877,440

(22) PCT Filed: Sep. 30, 2011

(86) PCT No.: PCT/JP2011/073163
§ 371 (c)(1),
(2), (4) Date: Apr. 2, 2013

(87) PCT Pub. No.: WO2012/046823
PCT Pub. Date: Apr. 12, 2012

(65) Prior Publication Data

US 2013/0195519 A1 Aug. 1, 2013

(30) Foreign Application Priority Data

| | | |
|---|---|---|
| Oct. 4, 2010 | (JP) | 2010-225218 |
| Oct. 4, 2010 | (JP) | 2010-225219 |
| Dec. 7, 2010 | (JP) | 2010-272695 |
| Sep. 28, 2011 | (JP) | 2011-212309 |

(51) Int. Cl.
*G03G 15/16* (2006.01)
*G03G 15/00* (2006.01)

(52) U.S. Cl.
CPC ..... *G03G 15/5004* (2013.01); *G03G 15/162* (2013.01); *G03G 2215/0132* (2013.01); *G03G 2215/1661* (2013.01)

(58) Field of Classification Search
CPC ..... G03G 15/162; G03G 15/5004; G03G 2215/0132; G03G 2215/1661
USPC ..... 399/66, 88, 90, 121, 297, 302, 308, 314
See application file for complete search history.

(56) References Cited

U.S. PATENT DOCUMENTS 5,809,387 A * 9/1998 Takeuchi ..... G03G 7/00 399/302
5,930,556 A 7/1999 Imamiya
(Continued)

FOREIGN PATENT DOCUMENTS

CN 1664717 A 9/2005
CN 1869837 A 11/2006
(Continued)

OTHER PUBLICATIONS

IIDA, Image forming Device, Jul. 6, 2001, JP2001-183916A machine translation.*

*Primary Examiner* — Francis Gray
(74) *Attorney, Agent, or Firm* — Canon USA, Inc., IP Division

(57) ABSTRACT

An image forming apparatus sequentially transfers toner images formed on a plurality of photosensitive drums onto an intermediate transfer member or a transfer material to form an image. The image forming apparatus includes an intermediate transfer belt provided with electrical conductivity, and a power supply for applying a voltage to a secondary transfer roller to pass a current from the secondary transfer roller to the plurality of photosensitive drums via the intermediate transfer belt, thus primarily transferring the toner images from the plurality of photosensitive drums onto the intermediate transfer belt.

34 Claims, 16 Drawing Sheets

(56) References Cited

U.S. PATENT DOCUMENTS

| | | | | |
|---|---|---|---|---|
| 6,226,486 | B1 | 5/2001 | Itou et al. | |
| 6,347,209 | B1 | 2/2002 | Bessho | |
| 6,442,356 | B2 | 8/2002 | Omata et al. | |
| 6,862,422 | B2 | 3/2005 | Aoki et al. | |
| 6,952,552 | B2 | 10/2005 | Aoki et al. | |
| 7,013,097 | B2 | 3/2006 | Akizuki et al. | |
| 7,139,498 | B2 | 11/2006 | Mashiba et al. | |
| 7,289,757 | B2 | 10/2007 | Sharma et al. | |
| 2001/0051056 | A1* | 12/2001 | Noguchi | G03G 15/0131 399/66 |
| 2005/0036807 | A1 | 2/2005 | Aoki | |
| 2005/0058473 | A1* | 3/2005 | Mizuno et al. | 399/302 |
| 2006/0288896 | A1 | 12/2006 | Fukui et al. | |
| 2009/0028594 | A1 | 1/2009 | Kojima | |
| 2009/0136270 | A1* | 5/2009 | Yamada | 399/308 |
| 2009/0148201 | A1* | 6/2009 | Sawai | 399/302 |
| 2010/0232820 | A1* | 9/2010 | Usami et al. | 399/66 |
| 2013/0188980 | A1* | 7/2013 | Ito et al. | 399/88 |
| 2013/0188981 | A1* | 7/2013 | Horiguchi | G03G 15/1605 399/88 |

FOREIGN PATENT DOCUMENTS

| | | | | | |
|---|---|---|---|---|---|
| CN | 101504528 | A | | 8/2009 | |
| JP | 10-268667 | A | | 10/1998 | |
| JP | 2000-235315 | A | | 8/2000 | |
| JP | 2001-125338 | A | | 5/2001 | |
| JP | 2001-175092 | A | | 6/2001 | |
| JP | 2001183916 | A | * | 6/2001 | |
| JP | 2001183916 | A | * | 7/2001 | G03G 15/16 |
| JP | 2003-035986 | A | | 2/2003 | |
| JP | 2004-102191 | A | | 4/2004 | |
| JP | 2005-250254 | A | | 9/2005 | |
| JP | 2006-047541 | A | | 2/2006 | |
| JP | 2006-259640 | A | | 9/2006 | |
| RU | 2373063 | C1 | | 11/2009 | |

* cited by examiner

[Fig. 6C

IMAGE FORMING APPARATUS HAVING A POWER SUPPLY COMMON TO PRIMARY TRANSFER AND SECONDARY TRANSFER

TECHNICAL FIELD

The present invention relates to an image forming apparatus such as a copying machine and a laser beam printer.

BACKGROUND ART

To achieve high-speed printing, an electrophotographic color image forming apparatus is known to include independent image forming units for forming yellow, magenta, cyan, and black images, sequentially transfer images from the image forming units for respective colors onto an intermediate transfer belt, and collectively transfer images from the intermediate transfer belt onto a recording medium.

Each of the image forming units for respective colors includes a photosensitive drum as an image bearing member. Each image forming unit further includes a charging member for charging the photosensitive drum and a developing unit for developing a toner image on the photosensitive drum. The charging member of each image forming unit contacts the photosensitive drum with a predetermined pressure contact force to uniformly charge the surface of the photosensitive drum at a predetermined polarity and potential by using a charging voltage applied from a voltage power supply dedicated for charging (not illustrated).

The developing unit of each image forming unit applies toner to an electrostatic latent image formed on the photosensitive drum to develop a toner image (visible image).

In each image forming unit, a primary transfer roller (primary transfer member) facing the photosensitive drum via the intermediate transfer belt primarily transfers the developed toner image from the photosensitive drum onto the intermediate transfer belt. The primary transfer roller is connected to a voltage power supply dedicated for primary transfer.

A secondary transfer member secondarily transfers the primarily transferred toner image from the intermediate transfer belt onto a transfer material. A secondary transfer roller (secondary transfer member) is connected to a voltage power supply dedicated for secondary transfer.

Japanese Patent Application Laid-Open No. 2003-35986 discusses a configuration with which each of four primary transfer rollers is connected to each of four voltage power supplies dedicated for primary transfer. Japanese Patent Application Laid-Open No. 2001-125338 discusses control for changing, before image formation operation, a transfer voltage to be applied to each primary transfer roller depending on sheet-passing durability of an intermediate transfer belt and a primary transfer roller and on resistance variation due to environmental variation.

However, a conventionally known primary transfer voltage setting has the following problem. Since an appropriate primary transfer voltage needs to be set in each image forming unit, a plurality of voltage power supplies is required. This increases the size of an image forming apparatus and the number of power supplies, resulting in a cost increase.

SUMMARY OF INVENTION

The present invention is directed to an image forming apparatus having appropriate primary and secondary transfer performances while reducing the number of voltage power supplies for applying a voltage to primary transfer members.

According to an aspect of the present invention, an image forming apparatus includes: a plurality of image bearing members configured to bear toner images; a rotatable endless intermediate transfer belt configured to secondarily transfer onto a transfer material the toner images primarily transferred from the plurality of image bearing members; a current supply member configured to contact the intermediate transfer belt; and a power supply configured to apply a voltage to the current supply member to secondarily transfer the toner images from the intermediate transfer belt onto a transfer material, wherein the intermediate transfer belt is provided with electrical conductivity capable of passing a current from a contact position of the current supply member in the rotational direction of the intermediate transfer belt to the plurality of image bearing members via the intermediate transfer belt, and wherein the power supply applies a voltage to the current supply member to primarily transfer the toner images from the plurality of image bearing members onto the intermediate transfer belt.

According to exemplary embodiments of the present invention, supplying a current in the circumferential direction of an intermediate transfer belt from a current supply member eliminates the need of preparing a voltage power supply for each of a plurality of primary transfer members, enabling primary and secondary transfer to be performed by one current supply member. Thus, the cost and size of the image forming apparatus can be reduced.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

FIGS. 6A to 6C are graphs illustrating surface potential measurement results for the intermediate transfer belt.

DESCRIPTION OF EMBODIMENTS

Various exemplary embodiments, features, and aspects of the invention will be described in detail below with reference to the drawings.

Figure 1:
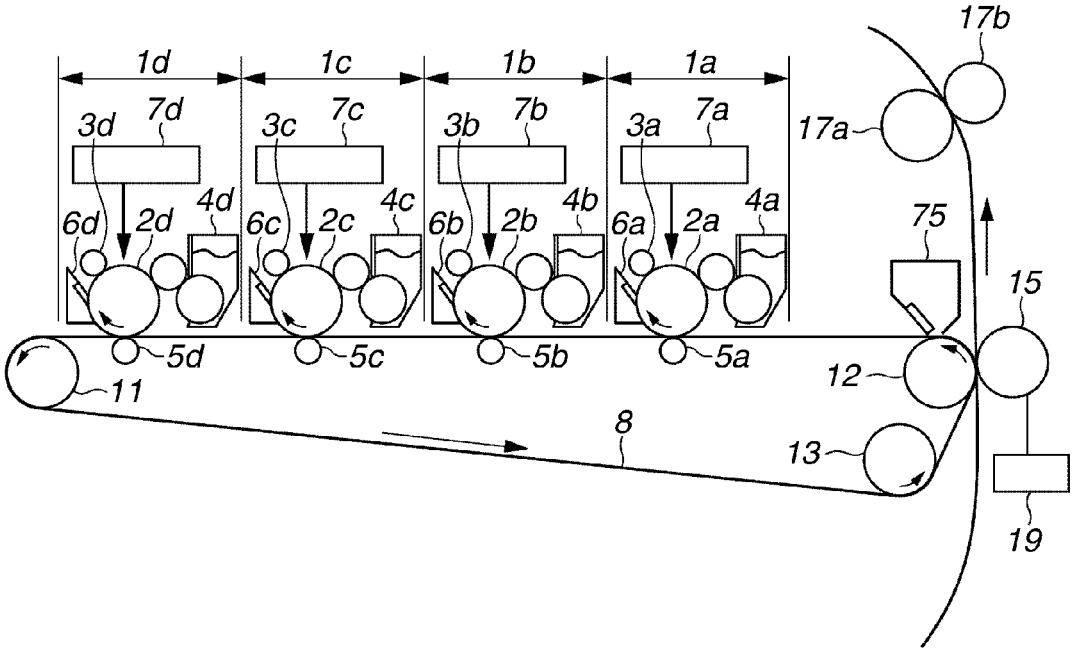
FIG. 1 is a sectional view schematically illustrating an image forming apparatus according to exemplary embodiments of the present invention.

FIG. 1 illustrates a configuration of an in-line type color image forming apparatus (having four drums) according to exemplary embodiments of the present invention. The image forming apparatus includes four image forming units: an image forming unit 1*a* for forming a yellow image, an image forming unit 1*b* for forming a magenta image, an image forming unit 1*c* for forming a cyan image, and an image forming unit 1*d* for forming a black image. These four image forming units are arranged on a line at fixed intervals.

The image forming units 1*a*, 1*b*, 1*c*, and 1*d* include photosensitive drums 2*a*, 2*b*, 2*c*, and 2*d* (image bearing members), respectively. In the present exemplary embodiment, each of the photosensitive drums 2*a*, 2*b*, 2*c*, and 2*d* is composed of a drum base (not illustrated) such as aluminum and a photosensitive layer (not illustrated), a negatively charged organic photosensitive member, on the drum base. The photosensitive drums 2*a*, 2*b*, 2*c*, and 2*d* are rotatably driven by a drive unit (not illustrated) at predetermined process speed.

Charging rollers 3*a*, 3*b*, 3*c*, and 3*d* and developing units 4*a*, 4*b*, 4*c*, and 4*d* are arranged around the photosensitive drums 2*a*, 2*b*, 2*c*, and 2*d*, respectively. Drum cleaning units 6*a*, 6*b*, 6*c*, and 6*d* are arranged around the photosensitive drums 2*a* 2*b*, 2*c*, and 2*d*, respectively. Exposure units 7*a*, 7*b*, 7*c*, and 7*d* are arranged above the photosensitive drums 2*a* 2*b*, 2*c*, and 2*d*, respectively. Yellow toner, cyan toner, magenta toner, and black toner are stored in the developing units 4*a*, 4*b*, 4*c*, and 4*d*, respectively. The regular toner charging polarity according to the present exemplary embodiment is the negative polarity.

An intermediate transfer belt 8 (a rotatable endless intermediate transfer member) is arranged facing the four image forming units. The intermediate transfer belt 8 is supported by a drive roller 11, a secondary transfer counter roller 12, and a tension roller 13 (these three rollers are collectively referred to as supporting rollers or supporting members), and rotated (moved) in a direction indicated by the arrow (counterclockwise direction) by the driving force of the drive roller 11 driven by a motor (not illustrated). Hereinafter, the rotational direction of the intermediate transfer belt 8 is referred to as a circumferential direction of the intermediate transfer belt 8. The drive roller 11 is provided with a surface layer made of high-friction rubber to drive the intermediate transfer belt 8. The rubber layer provides electrical conductivity with a volume resistivity of $10^5$ Ω-cm or below. The secondary transfer counter roller 12 and a secondary transfer roller 15 form a secondary transfer section via the intermediate transfer belt 8. The secondary transfer counter roller 12 is provided with a surface layer made of rubber to provide electrical conductivity with a volume resistivity of $10^5$ Ω-cm or below. The tension roller 13 is made of a metal roller which gives tension with a total pressure of about 60 N to the intermediate transfer belt 8 to be driven and rotated by the rotation of the intermediate transfer belt 8.

The drive roller 11, the secondary transfer counter roller 12, and the tension roller 13 are grounded via a resistor having a predetermined resistance value. The present exemplary embodiment uses resistors having three different resistance values of 1 GΩ, 100 MΩ, and 10 MΩ. Since the resistance value of the rubber layers of the driver roller 11 and the secondary transfer counter roller 12 is sufficiently smaller than 1 GΩ, 100 MΩ, and 10 MΩ, electrical effects of these rollers can be ignored.

The secondary transfer roller 15 is an elastic roller having a volume resistivity of $10^7$ to $10^9$ Ω-cm and a rubber hardness of 30 degrees (Asker C hardness meter). The secondary transfer roller 15 is pressed onto the secondary transfer counter roller 12 via the intermediate transfer belt 8 with a total pressure of about 39.2 N. The secondary transfer roller 15 is driven and rotated by the rotation of the intermediate transfer belt 8. A voltage of −2.0 to 7.0 kV from a transfer power supply 19 can be applied to the secondary transfer roller 15. In the present exemplary embodiment, a voltage from the transfer power supply 19 (a common voltage power supply for primary and secondary transfer) is applied to the secondary transfer roller 15 (described below). The secondary transfer roller 15 serves as a current supply member for supplying a current in the circumferential direction of the intermediate transfer belt 8.

A belt cleaning unit 75 for removing and collecting residual transfer toner remaining on the surface of the intermediate transfer belt 8 is arranged on the outer surface of the intermediate transfer belt 8. In the rotational direction of the intermediate transfer belt 8, a fixing unit 17 including a fixing roller 17*a* and a pressure roller 17*b* is arranged on the downstream side of the secondary transfer section at which the secondary transfer counter roller 12 contacts the secondary transfer roller 15.

An image formation operation will be described below.

When a controller issues a start signal for starting the image formation operation, transfer materials (recording mediums) are sent out one by one from a cassette (not illustrated) and then conveyed to a registration roller (not illustrated). At this timing, the registration roller (not illustrated) is stopped and the leading edge of the transfer material stands by at a position immediately before the secondary transfer section. When the start signal is issued, on the other hand, the photosensitive drums 2*a*, 2*b*, 2*c*, and 2*d* in the image forming units 1*a*, 1*b*, 1*c*, and 1*d*, respectively, start rotating at predetermined process speed. In the present exemplary embodiment, the photosensitive drums 2*a*, 2*b*, 2*c*, and 2*d* are uniformly charged to the negative polarity by the charging rollers 3*a*, 3*b*, 3*c*, and 3*d*, respectively. Then, exposure units 7*a*, 7*b*, 7*c*, and 7*d* irradiate the photosensitive drums 2*a*, 2*b*, 2*c* and 2*d*, respectively, with laser beams to perform scanning exposure to form electrostatic latent images thereon.

The developing unit 4*a*, to which a developing voltage having the same polarity as the charging polarity (negative polarity) of the photosensitive drum 2*a* is applied, applies yellow toner to the electrostatic latent image formed on the photosensitive drum 2*a* to visualize it as a toner image. The charge amount and the exposure amount are adjusted so that each photosensitive drum has a −500 V potential after being charged by the charging roller and a −100 V potential (image portion) after being exposed by the exposure unit. A developing bias voltage is −300 V. The process speed is 250 mm/sec. An image formation width which is a length in a direction perpendicular to the conveyance direction (rotational direction) is set to 215 mm. The toner charge amount is set to −40 μC/g. The toner amount on each photosensitive drum for solid image is set to 0.4 mg/cm2.

The yellow toner image is primarily transferred onto the rotating intermediate transfer belt 8. A portion facing each photosensitive drum, at which a toner image is transferred from each photosensitive drum onto the intermediate transfer belt 8, is referred to as primary transfer section. A plurality of primary transfer sections corresponding to the plurality of image bearing members is provided on the intermediate transfer belt 8. A configuration for primarily transferring the yellow toner image onto the intermediate transfer belt 8 in the present exemplary embodiment will be described below.

The plurality of primary transfer sections corresponding to the plurality of image bearing members transfers toner images from the plurality of image bearing members onto the intermediate transfer belt 8.

Referring to FIG. 1, counter members 5*a*, 5*b*, 5*c*, and 5*d* are arranged facing the image forming units 1*a*, 1*b*, 1*c*, and 1*d*, respectively, via the intermediate transfer belt 8. The counter members 5*a*, 5*b*, 5*c*, and 5*d* press respective facing photosensitive drums 2*a*, 2*b*, 2*c*, and 2*d* via the intermediate transfer belt 8 to form primary transfer section portions that can be kept wide and stable in this way. In the present exemplary embodiment, the counter members 5*a*, 5*b*, 5*c*, and 5*d* are electrically insulated, i.e., they do not serve as voltage-applied members connected to the voltage power supplies for primary transfer. Since voltage-applied members as illustrated in FIG. 4 have electrical conductivity so that a desired current flows therein, resistance value adjustment is made for the voltage-applied members causing a cost increase.

A region on the intermediate transfer belt 8 where the yellow toner image has been transferred thereon is moved to the image forming unit 1*b* by the rotation of the intermediate transfer belt 8. Then, in the image forming unit 1*b*, a magenta toner image formed on the photosensitive drum 2*b* is similarly transferred onto the intermediate transfer belt 8 so that the magenta toner image is superimposed onto the yellow toner image. Likewise, in the image forming units 1*c* and 1*d*, a cyan toner image formed on the photosensitive drum 2*c* and then a black toner image formed on the photosensitive drum 2*d* are respectively transferred onto the intermediate transfer belt 8 so that the cyan toner image is superimposed onto the two-color (yellow and magenta) toner image and then the black toner image is superimposed onto the three-color (yellow, magenta, and cyan) toner image, thus forming a full color toner image on the intermediate transfer belt 8.

Then, in synchronization with a timing when the leading edge of the full color toner image on the intermediate transfer belt 8 is moved to the secondary transfer section, a transfer material P is conveyed to the secondary transfer section by a registration roller (not illustrated). The full color toner image on the intermediate transfer belt 8 is secondarily transferred at one time onto the transfer material P by the secondary transfer roller 15 to which the secondary transfer voltage (a voltage having an opposite polarity of toner polarity (positive polarity)) is applied. The transfer material P having the full color toner image formed thereon is conveyed to the fixing unit 17. A fixing nip portion composed of a fixing roller 17*a* and a pressure roller 17*b* applies heat and pressure to the full color toner image to fix it onto the surface of the transfer material P and then discharges it to the outside.

Figure 4:
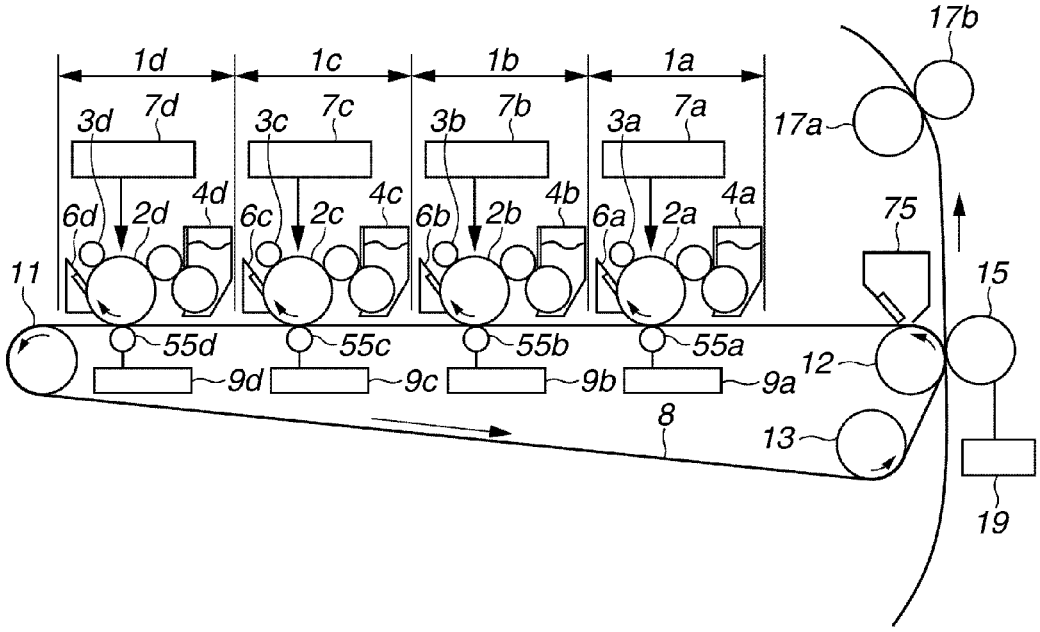
FIG. 4 is a sectional view schematically illustrating an image forming apparatus having a transfer power supply dedicated for primary transfer in each image forming unit.

The present exemplary embodiment is characterized in that primary transfer for transferring toner images from the photosensitive drums 2*a*, 2*b*, 2*c*, and 2*d* onto the intermediate transfer belt 8 is performed without applying a voltage to primary transfer rollers 55*a*, 55*b*, 55*c*, and 55*d*, as illustrated in FIG. 4.

To describe the features of the present exemplary embodiment, the volume resistivity, the surface resistivity, and the circumferential resistance value of the intermediate transfer belt 8 will be described below. A definition of the circumferential resistance value and a method for measuring the circumferential resistance value will be described below.

The volume and surface resistivity of the intermediate transfer belt 8 used in the present exemplary embodiment will be described below.

In the present exemplary embodiment, the intermediate transfer belt 8 has a base layer made of a 100-μm thick polyphenylene sulfide (PPS) resin containing distributed carbon for electrical resistance value adjustment. The resin used may be polyimide (PI), polyvinylidene fluoride (PVdF), nylon, polyethylene terephthelate (PET), polybutylene terephthelate (PBT), polycarbonate, polyether ether ketone (PEEK), polyethylene naphthalate (PEN), and on.

The intermediate transfer belt 8 has a multilayer configuration. Specifically, the base layer is provided with an outer surface layer made of a 0.5- to 3-μm thick high-resistance acrylic resin. The high-resistance surface layer is used to obtain an effect of improving the secondary transfer performance of small-sized paper by reducing a current difference between a sheet-passing region and a non-sheet-passing region in the longitudinal direction of the secondary transfer section.

A method for manufacturing a belt will be described below. The present exemplary embodiment employs a method for manufacturing a belt based on the inflation fabricating method. PPS (basis material) and a blending component such as carbon black (conductive material powder) are melted and mixed by using a two-axis sand mixer. The obtained mixed object is extrusion-molded by using an annular dice to form an endless belt.

An ultraviolet ray hardening resin is spray-coated onto the surface of the molded endless belt and, after the resin dries, ultraviolet ray is radiated onto the belt surface to harden the resin, thus forming a surface coating layer. Since too thick a coating layer is easy to crack, the amount of coated resin is adjusted so that the coating layer becomes 0.5- to 3-μm thick.

The present exemplary embodiment uses carbon black as electrical conductive material powder. An additive agent for adjusting the resistance value of the intermediate transfer belt 8 is not limited. Exemplary conductive fillers for resistance value adjustment include carbon black and many other conductive metal oxides. Agents for non-filler resistance value adjustment include various metal salts, ion conductive materials with low-molecular weight such as glycol, antistatic resins containing ether bond, hydroxyl group, etc., in molecules, and organic polymer high-molecular compounds.

Although increasing the amount of additive carbon lowers the resistance value of the intermediate transfer belt 8, too much amount of additive carbon decreases the strength of the belt making it easy to crack. In the present exemplary embodiment, the resistance of the intermediate transfer belt 8 is lowered within an allowable range of belt strength usable for the image forming apparatus.

In the present exemplary embodiment, the Young's modulus of the intermediate transfer belt 8 is about 3000 MPas. The Young's modulus E was measured conforming to JIS-K7127, "Plastics—Determination of tensile properties" by using a material under test having a thickness of 100 μm.

Table 1 illustrates the amount of additive carbon (in relative ratio) for various bases (PPS for a basis material).

TABLE 1

| | Amount of additive carbon (in relative ratio) | Coating layer |
|---|---|---|
| Comparative sample belt | 0.5 | Not provided |
| Belt A | 1 | Provided |
| Belt B | 1.5 | Provided |
| Belt C | 2 | Provided |
| Belt D | 1.5 | Not provided |
| Belt E | 2 | Not provided |

Table 1 also illustrates the presence or absence of a surface coating layer. For example, the amount of additive carbon for the belt B is 1.5 times that for the belt A, and the amount of additive carbon for the belt C is twice that for the belt A. The belts A, B, and C are provided with a surface layer, and the belts D and E are not provided therewith (a single-layer belt). The amount of additive carbon for the belt B is the same as that for the belt D, and the amount of additive carbon for the belt C is the same as that for the belt E.

A comparative sample belt made of polyimide was made with the amount of additive carbon (in relative ratio) changed for resistance value adjustment. The comparative sample belt has an amount of additive carbon (in relative ratio) of 0.5 and volume resistivity of $10^{10}$ to $10^{11}$ Ω-cm. As an intermediate transfer belt, this comparative sample belt has an ordinary resistance value.

Results of volume and surface resistivity measurement for the comparative sample belt and the belts A to E will be described below.

The volume and surface resistivity of the comparative sample belt and the belts A to E were measured by using the Hiresta UP (MCP-HT450) resistivity meter from MITSUBISHI CHEMICAL ANALYTECH. Table 2 illustrates measured values of the volume and surface resistivity (outer surface of each belt). The volume and surface resistivity were measured conforming to JIS-K6911, "Testing method for thermosetting plastics" by using a conductive rubber electrode after obtaining preferable contact between the electrode and the surface of each belt. Measurement conditions include application time of 30 seconds and applied voltages of 10 V and 100 V.

TABLE 2

| | Volume resistivity (Ω-cm) | | Surface resistivity (Ω/sq.) | |
|---|---|---|---|---|
| | Applied voltage | | | |
| | 10 V | 100 V | 10 V | 100 V |
| Comparative sample belt | over | $1.0 \times 10^{10}$ | over | $1.0 \times 10^{10}$ |
| Belt A | over | $2.0 \times 10^{12}$ | over | $1.0 \times 10^{12}$ |
| Belt B | $1.0 \times 10^{12}$ | under | $4.0 \times 10^{11}$ | $2.0 \times 10^{8}$ |
| Belt C | $1.0 \times 10^{10}$ | under | $5.0 \times 10^{10}$ | under |

TABLE 2-continued

| | Volume resistivity (Ω-cm) | | Surface resistivity (Ω/sq.) | |
|---|---|---|---|---|
| | Applied voltage | | | |
| | 10 V | 100 V | 10 V | 100 V |
| Belt D | $5.0 \times 10^{6}$ | under | $5.0 \times 10^{6}$ | under |
| Belt E | under | under | under | under |

When the applied voltage is 100 V, the comparative sample belt exhibits volume resistivity of $1.0\times10^{10}$ Ω-cm and surface resistivity of $1.0\times10^{10}$ Ω/sq. When the applied voltage is 10 V, however, the comparative sample belt has too small a current flow and hence is unable to be subjected to volume resistivity measurement. In this case, the resistivity meter displays "over."

When the applied voltage is 100 V, the belts B, C, and D have too large a current flow because of the low resistance and hence are unable to be subjected to volume resistivity measurement. In this case, the resistivity meter displays "under." When the applied voltage is 100 V, the belt B exhibits surface resistivity of $2.0\times10^{8}$ Ω/sq., but the belts C and D are unable to be subjected to surface resistivity measurement ("under").

Referring to Table 2, when the applied voltage is 10 V, the belt A is unable to be subjected to volume and surface resistivity measurement. When the applied voltage is 100 V, the belt A exhibits higher surface resistivity than the comparative sample belt. This phenomenon is caused by the effect of the coating layer, i.e., the belt A having a high-resistance surface coating layer has a higher resistance than the comparative sample belt not having a surface coating layer.

The comparison between the belts B and D and the comparison between the belts C and E indicate that the coating layer provides a high resistance value. The comparison between the belts B and C and the comparison between the belts D and E indicate that increasing the amount of additive carbon decreases the resistance value. The belt E provides too low a resistance value and hence is unable to be subjected to measurement of all items.

In the present exemplary embodiment, it is necessary to use the intermediate transfer belt 8 having such volume and surface resistivity that give "under" display in Table 2. Therefore, a resistance value other than the volume and surface resistivity defined for the intermediate transfer belt 8 was measured. Another resistance value defined for the intermediate transfer belt 8 is the above-mentioned circumferential resistance.

A method for obtaining the circumferential resistance of the intermediate transfer belt 8 will be described below.

Figure 2A:
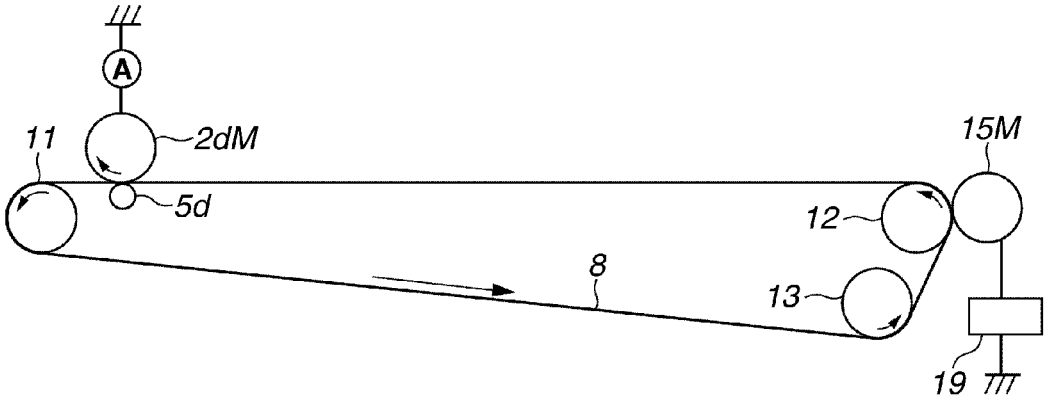
FIGS. 2A and 2B are sectional views schematically illustrating a method for measuring the circumferential resistance value of an intermediate transfer belt according to exemplary embodiments of the present invention.
Figure 2B:
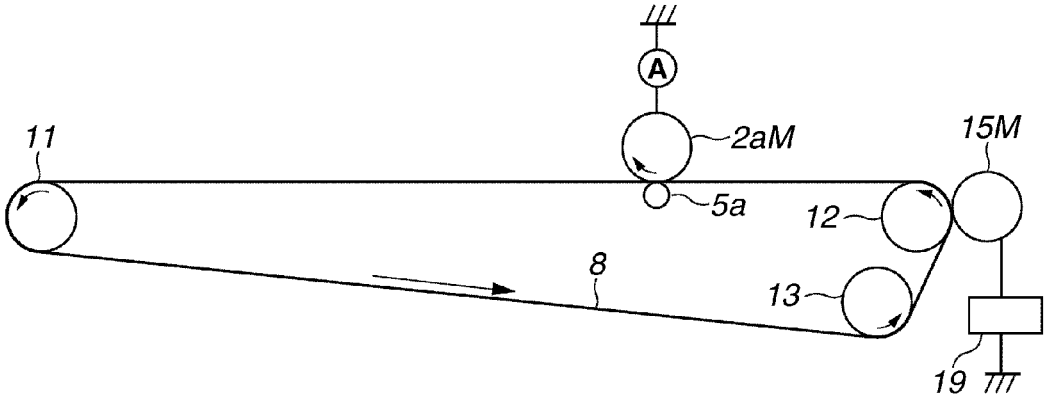

In the present exemplary embodiment, the circumferential resistance of the intermediate transfer belt 8 having a lowered resistance was measured with a method illustrated in FIGS. 2A and 2B. Referring to FIG. 2A, when a fixed voltage (measurement voltage) is applied from a high-voltage power supply (the transfer power supply 19) to an outer surface roller 15M (first metal roller), the method detects a current flowing in an ammeter (current detection unit) connected to a photosensitive drum 2*d*M (second metal roller) of the image forming unit 1*d*. Based on the detected current value, the method obtains a resistance value of the intermediate transfer belt 8 between contact portions of the photosensitive drum 2*d*M and the outer surface roller 15M. Specifically, the method measures a current flowing in the circumferential direction (rotational direction) of the intermediate transfer belt 8 and then divides the measurement voltage value by the measured current value to obtain the resistance value of the intermediate transfer belt 8. To eliminate the effect of resistances other than the resistance of the intermediate transfer belt 8, the outer surface roller 15M and the photosensitive drum 2*d*M made only of metal (aluminum) are used. For this reason, the reference numerals of the roller and belt are followed by letter M (Metal). In the present exemplary embodiment, the distance between the contact portion of the outer surface roller 15M and the photosensitive drum 2*d*M is 370 mm (on the upper surface side of the intermediate transfer belt 8) and 420 mm (on the lower surface side thereof).

Figure 3A:
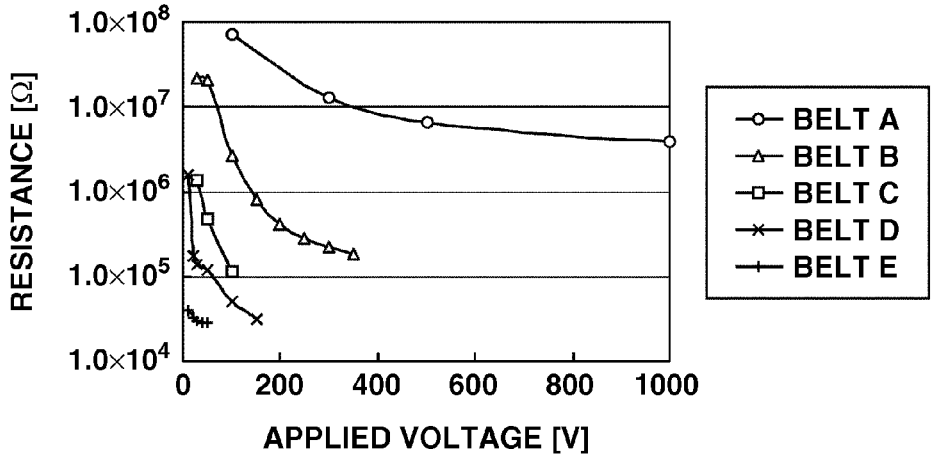
FIGS. 3A and 3B are graphs illustrating circumferential resistance measurement results for the intermediate transfer belt.

FIG. 3A illustrates a resistance measurement result for the belts A to E with varying applied voltage based on the above-mentioned measurement method. With this measurement method, the resistance in the circumferential direction (rotational direction) of the intermediate transfer belt 8 was measured. In the present exemplary embodiment, therefore, the resistance of the intermediate transfer belt 8 measured with this measurement method is referred to as circumferential resistance (in Ω).

All of the belts A to E have a tendency that the resistance gradually decreases with increasing applied voltage. This tendency is seen with belts with which a resin contains distributed carbon.

The method in FIG. 2B differs from the method in FIG. 2A only in the ammeter position. In this case, the resistance measurement result almost coincides with that in FIG. 3B, which means that the measurement method according to the present exemplary embodiment is irrelevant to the ammeter position.

With the method illustrated in FIGS. 2A and 2B, resistance measurement is accomplished with the belts A to E but not with the comparative sample belt. This is because the comparative sample belt is a belt used for an image forming apparatus in which the primary transfer rollers 55*a*, 55*b*, 55*c*, and 55*d* are connected with respective voltage power supplies as illustrated in FIG. 4

The image forming apparatus having the configuration in FIG. 4 is designed to provide high volume and surface resistivity of the intermediate transfer belt 8 so that adjacent voltage power supplies are not mutually affected (interfered) by a current flowing therein via the intermediate transfer belt 8. The comparative sample belt has a resistance to such an extent that the primary transfer sections do not interfere with each other even when a voltage is applied to the primary transfer rollers 55*a*, 55*b*, 55*c*, and 55*d*. The comparative sample belt is designed not to easily produce a current flow in the circumferential direction. A belt like the comparative sample belt is defined as a high-resistance belt, and a belt having a current flow in the circumferential direction like the belts A to E is defined as a conductive belt.

Figure 3B:
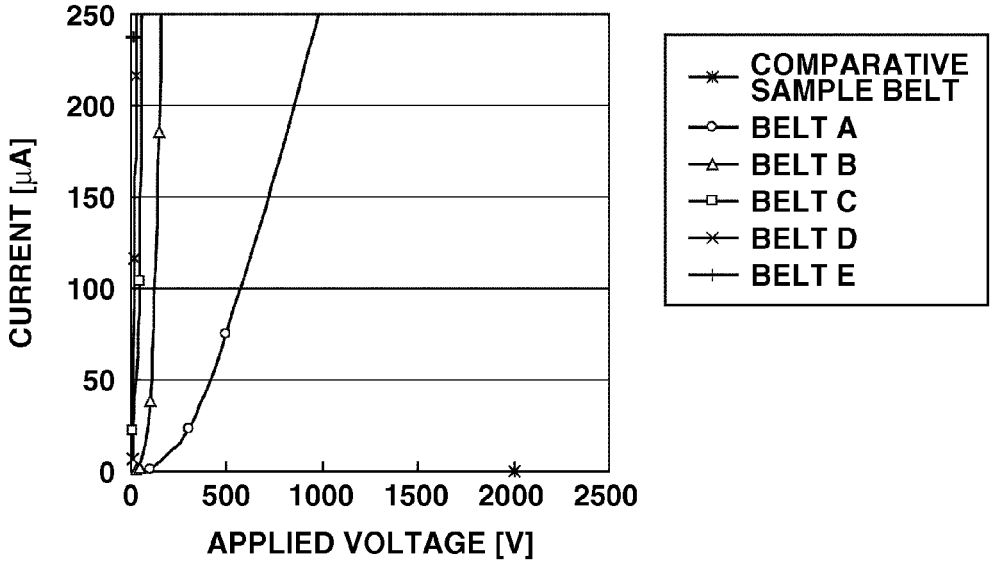

FIG. 3B is a graph formed by plotting current values measured by the measurement method used for FIG. 2A. Referring to FIG. 3A, the resistance value (in Ω) assigned to the vertical axis is obtained by dividing the current value measured in FIG. 3B by the applied voltage.

Referring to FIG. 3B, with the comparative sample belt, no current flowed in the circumferential direction even when the applied voltage was 2000 V. With the belts A to E, however, a current of 50 μA or above flowed even when the applied voltage was 500 V or below. The present exemplary embodiment uses the intermediate transfer belt 8 having a circumferential resistance of $10^4$ to $10^8$Ω. With a circumferential resistance higher than $10^8$Ω, a current does not easily flow in the circumferential direction and hence the desired primary transfer performance cannot be ensured. Accordingly, in the present exemplary embodiment, a belt having a circumferential resistance of $10^4$ to $10^8$Ω is used as a belt adapted for the desired primary transfer performance.

Figure 5A:
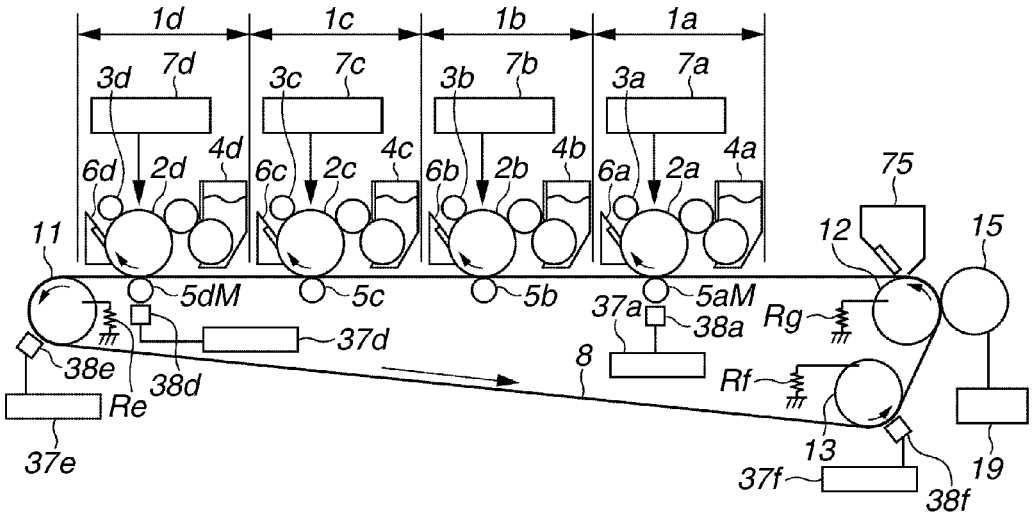
FIGS. 5A and 5B are sectional views schematically illustrating a method for measuring a potential of the intermediate transfer belt.
Figure 5B:
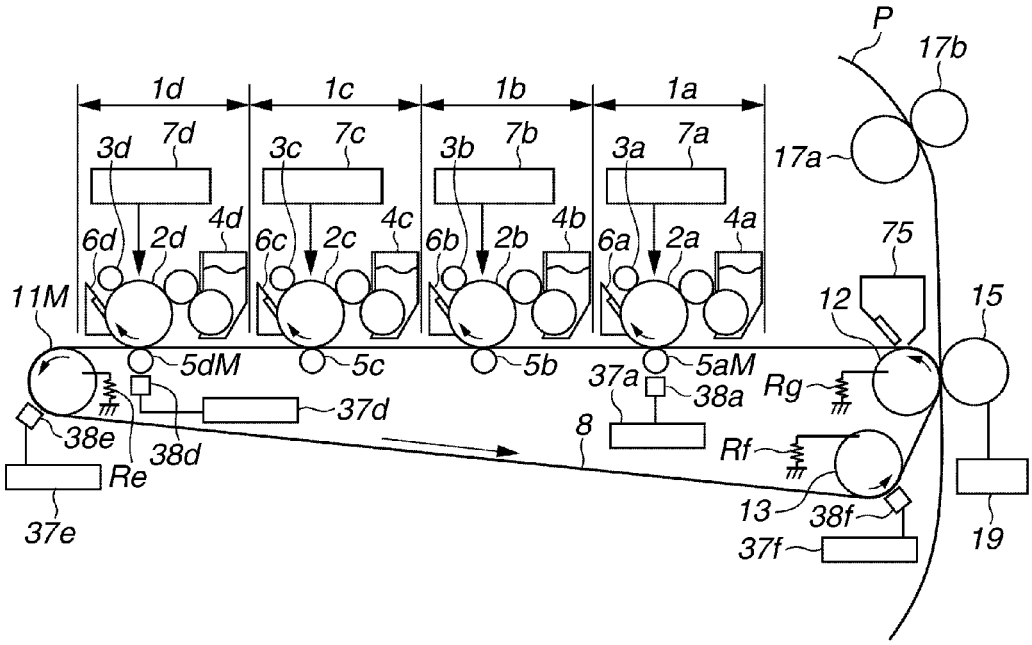

A surface potential of the intermediate transfer belt 8 having a circumferential resistance of $10^4$ to $10^8$Ω will be described below. FIGS. 5A and 5B illustrate a method for measuring the surface potential of the intermediate transfer belt 8. Referring to FIGS. 5A and 5B, potential measurement is made at four different portions by using four surface potential meters. Metal rollers 5*d*M and 5*a*M are used for measurement.

A surface potential meter 37*a* and a measurement probe 38*a* are used to measure the potential of the primary transfer roller 5*a*M (metal roller) of the image forming unit 1*a*. The MODEL 344 surface potential meters from TREK JAPAN were used. Since the metal rollers 5*d*M and 5*a*M have the same potential as the inner surface of the intermediate transfer belt 8, this method can be used to measure the inner surface potential of the intermediate transfer belt 8. Similarly, a surface potential meter 37*d* and a measurement probe 38*d* are used to measure the inner surface potential of the intermediate transfer belt 8 based on the potential of the primary transfer roller 5*d*M (metal roller) of the image forming unit 1*d*.

A surface potential meter 37*e* and a measurement probe 38*e* are arranged facing a drive roller 11M to measure the outer surface potential of the intermediate transfer belt 8. A surface potential meter 37*f* and a measurement probe 38*f* are arranged facing the tension roller 13 to measure the outer surface potential of the intermediate transfer belt 8. Resistors Re, Rf, and Rg are connected to the drive roller 11M, the secondary transfer counter roller 12, and the tension roller 13, respectively.

When the potential of the intermediate transfer belt 8 was measured with this measurement method, there was almost no potential difference between measurement portions, and the intermediate transfer belt 8 exhibited almost the same potential therein. Specifically, although the intermediate transfer belt 8 used in the present exemplary embodiment has a resistance value to some extent, it can be considered as a conductive belt.

Figure 6A:
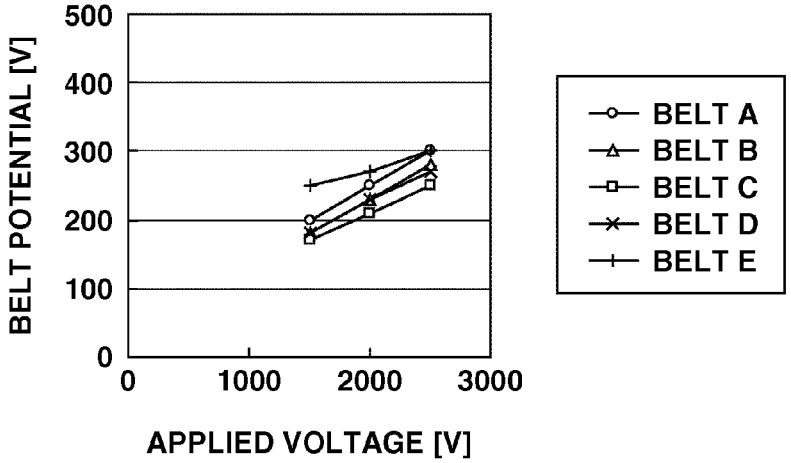
Figure 6B:
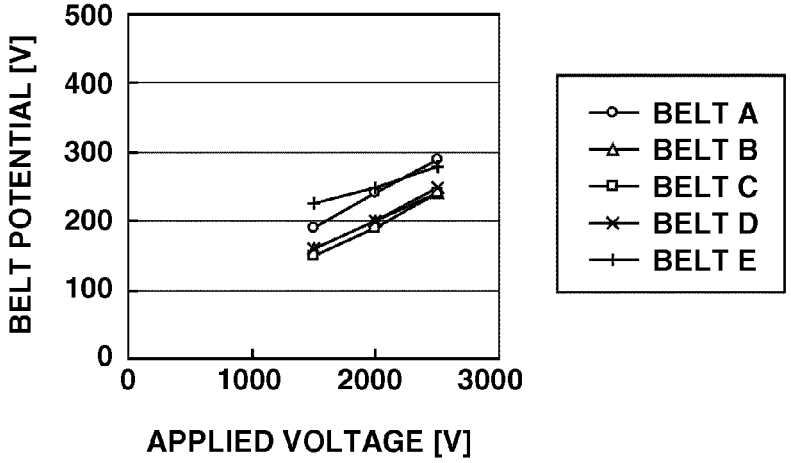
Figure 6B:
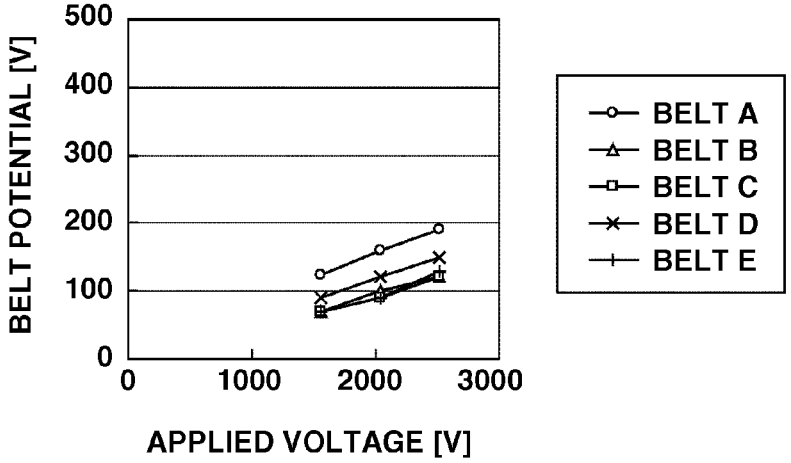

FIGS. 6A to 6C illustrate surface potential measurement results for the intermediate transfer belt 8. FIG. 6A illustrates a result when the resistors Re, Rf, and Rg have a resistance of 1 GΩ. The vertical axis is assigned a voltage applied to the transfer power supply 19 and the horizontal axis is assigned the potential of the intermediate transfer belt 8. FIG. 6A illustrates a measurement result for the belts A to E.

Similarly, FIG. 6B illustrates a result when the resistors Re, Rf, and Rg have a resistance of 100 MΩ. FIG. 6C illustrate a result when the resistors Re, Rf, and Rg have a resistance of 10 MΩ.

With any belt, the surface potential increases with increasing applied voltage, and decreases with decreasing resistance values of the resistors Re, Rf, and Rg (1 GΩ, 100 MΩ, and 10 MΩ in this order). Although all of the resistors Re, Rf, and Rg have the same resistance, it is known that decreasing the resistance of any one resistor decreases the surface potential of each belt accordingly.

With an intermediate transfer belt having a resistance with which a current does not flow in the circumferential direction like the comparative sample belt, the surface potential of each belt cannot be measured with the above method. Potential measurement probes cannot be arranged with a configuration with which a voltage is applied from a dedicated power supply 9 to the primary transfer rollers 55*a*, 55*b*, 55*c*, and 55*d* as illustrated in FIG. 4. Even if potential measurement probes are arranged facing supporting rollers 11, 12, and 13, the surface potential of the intermediate transfer belt 8 at the primary transfer sections cannot be measured since the potential differs at different positions in the circumferential direction.

A reason why toner images can be transferred from the photosensitive drums 2*a*, 2*b*, 2*c*, and 2*d* to the intermediate transfer belt 8 with the configuration according to the present exemplary embodiment will be described below with reference to FIGS. 7A to 7D.

Figure 7A:
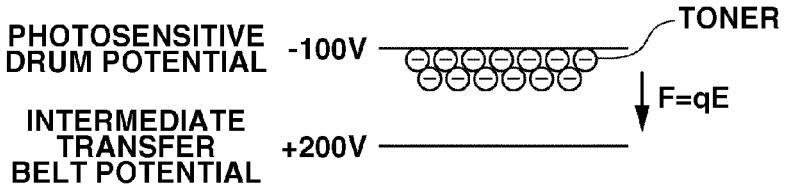
FIGS. 7A to 7D illustrate primary transfer according to exemplary embodiments of the present invention.

FIG. 7A illustrates a potential relation at each primary transfer section. The potential of each photosensitive drum is −100 V at the toner portion (image portion), and the surface potential of the intermediate transfer belt 8 is +200 V. Toner having a charge amount q developed on the photosensitive drum is subjected to a force F in the direction of the intermediate transfer belt 8 and then primarily transferred by an electric field E formed by the potential of the photosensitive drum and the potential of the intermediate transfer belt 8.

Figure 7B:
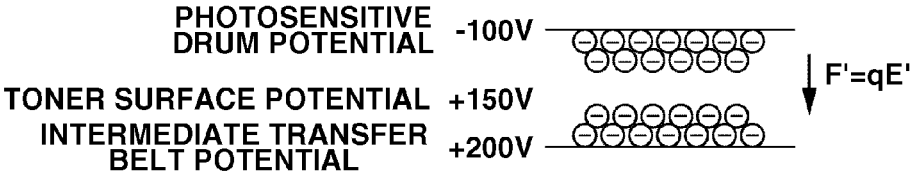

FIG. 7B illustrates multiplexed transfer which refers to processing for primarily transferring toner onto the intermediate transfer belt 8 and then further primarily transferring toner of other color onto the former toner. FIG. 7B illustrates a state where toner is negatively charged and the toner surface potential is +150 V by the transferred toner. In this case, toner on each photosensitive drum is subjected to a force F' in the direction of the intermediate transfer belt 8 and then primarily transferred by an electric field E' formed by the potential of the photosensitive drum and the surface potential of toner.

Figure 7C:
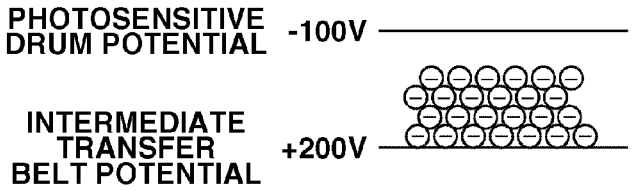

FIG. 7C illustrates a state where multiplexed transfer is completed.

Primary transfer of toner depends on the toner charge amount and a potential difference between the potential of the photosensitive drum and the potential of the intermediate transfer belt 8. This means that a certain fixed potential of the intermediate transfer belt 8 is necessary to ensure the primary transfer performance.

Under the above-mentioned conditions of the present exemplary embodiment, the potential of the intermediate transfer belt 8 necessary to primarily transfer the developed toner image on the photosensitive drum is considered to be 200 V or higher.

Figure 7D:
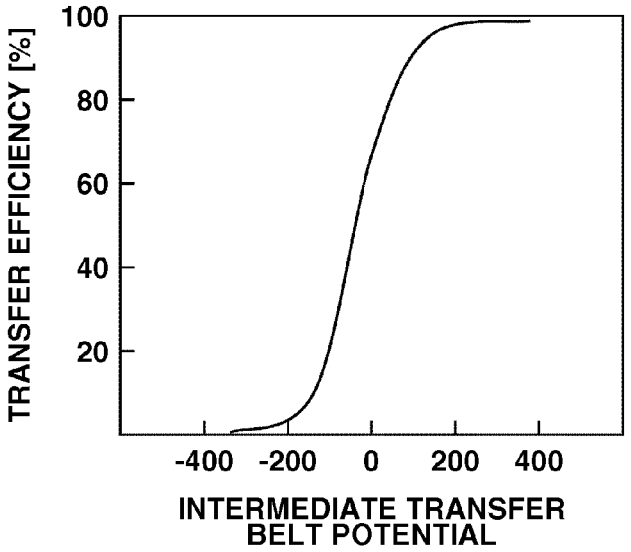

FIG. 7D is a graph illustrating a relation between the potential of the intermediate transfer belt 8 assigned to the horizontal axis and a transfer efficiency assigned to the vertical axis. The transfer efficiency is an index of transfer performance which indicates what percentage of the developed toner image on the photosensitive drum has been transferred onto the intermediate transfer belt 8. Generally, when the transfer efficiency is 95% or higher, toner is determined to have normally been transferred. FIG. 7D illustrates that 98% or above of toner has been transferred well by a potential of the intermediate transfer belt 8 of 200 V or higher.

In this case, all of the image forming units 1*a*, 1*b* 1*c*, and 1*d* have the same potential difference between each photosensitive drum and the intermediate transfer belt 8. More specifically, at all of the primary transfer sections for the image forming units 1*a*, 1*b*, 1*c*, and 1*d*, a potential difference of 300 V is formed between a potential of each photosensitive drum of −100 V and a potential of the intermediate transfer belt 8 of +200 V. This potential difference is required for multiplexed transfer for the above-mentioned three different toner colors (300% toner amount assuming the amount for monochrome solid as 100%), and is almost equivalent to that formed when a primary transfer bias is applied to respective primary transfer rollers with the conventional primary transfer configuration. An ordinary image forming apparatus does not perform image forming with 400% toner amount even if it is provided with toner of four colors. Instead, the image forming apparatus is capable of sufficient full color image formation with a maximum toner amount of about 210% to 280%.

The present exemplary embodiment, therefore, enables primary transfer by passing a current in the circumferential direction of the intermediate transfer belt 8 so that a predetermined surface potential of the intermediate transfer belt 8 is obtained. In other words, the transfer power supply 19 sends a current from the secondary transfer roller 15 to the photosensitive drums 2*a*, 2*b*, 2*c*, and 2*d* via the intermediate transfer belt 8 to achieve primary transfer. The present exemplary embodiment enables primary and secondary transfer by using one transfer power supply to apply a voltage to the secondary transfer roller 15 (secondary transfer member). Secondary transfer refers to processing for moving primarily transferred toner on the intermediate transfer belt 8 to a transfer material by using the Coulomb's force similarly to primary transfer. According to conditions of the present exemplary embodiment, quality paper (with a grammage of 75 g/m2) is used as a transfer material, and the secondary transfer voltage required for secondary transfer is 2 kV or above.

Figure 8A:
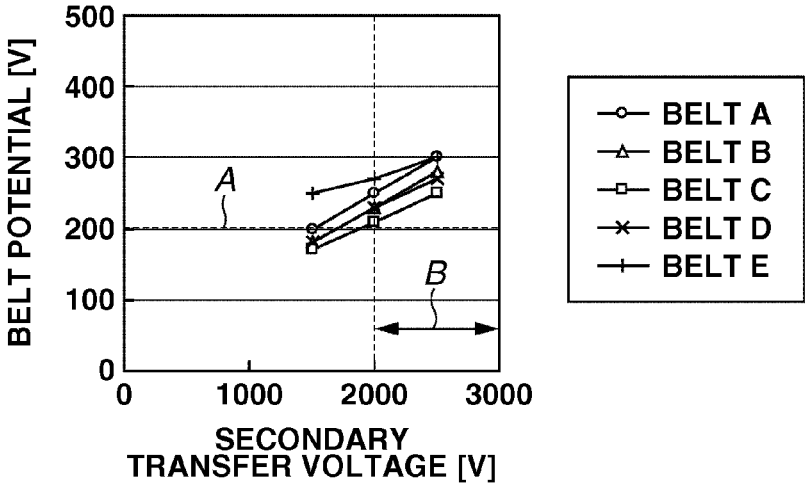
FIGS. 8A to 8C are graphs illustrating a relation between a potential measurement result for the intermediate transfer belt and a secondary transfer voltage when a transfer material is not passing through a secondary transfer section.
Figure 8B:
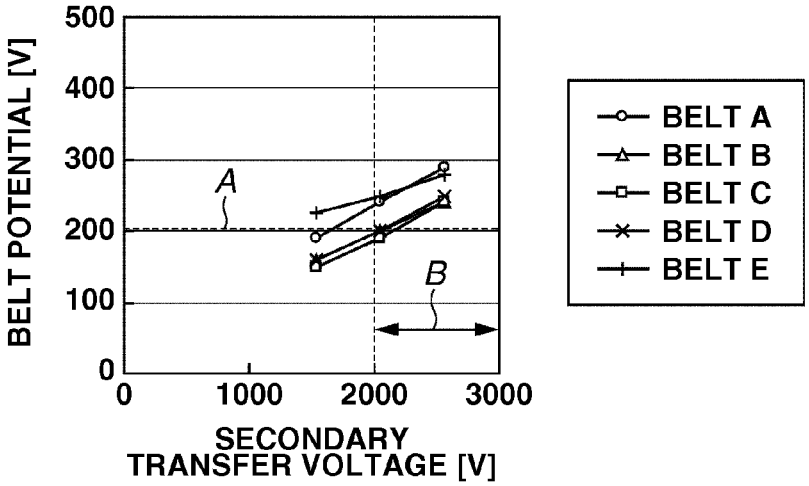
Figure 8C:
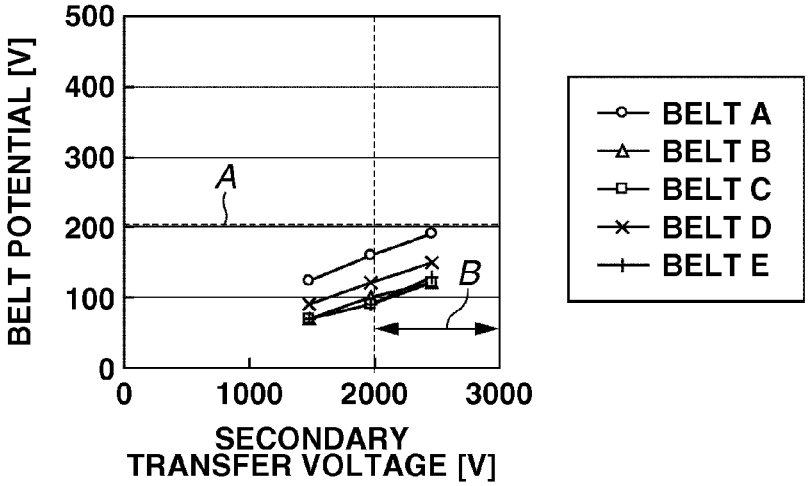

FIGS. 8A to 8C illustrate measurement results obtained when primary and secondary transfer achieving conditions are taken into account for the potential of the intermediate transfer belt 8 in FIGS. 6A to 6C. Referring to FIGS. 8A to 8C, a dotted line A indicates the potential of the intermediate transfer belt 8 necessary to perform primary transfer, and a range B indicates a secondary transfer setting range. FIGS. 8A, 8B, and 8C indicate measurement results when a resistor with a resistance of 1 GΩ, 100 MΩ, and 10 MΩ is used, respectively. In the case of 1 GΩ and 100 MΩ resistances (FIGS. 8A and 8B, respectively), applying a secondary transfer voltage having a predetermined value (2000 V) or higher to the intermediate transfer belt 8 produces a surface potential of the intermediate transfer belt 8 having a predetermined voltage (200 V in the present exemplary embodiment) or higher. In the present exemplary embodiment, both primary and secondary transfer is achieved in a region where the surface potential of the intermediate transfer belt 8 equals the predetermined potential or higher. In the case of 10 MΩ resistance (FIG. 8C), a secondary transfer voltage higher than 2000 V is required. Even in the case of 10 MΩ resistance, although increasing the secondary transfer voltage achieves secondary transfer, the capacity of the transfer power supply 19 needs to be actually increased to pass a current to the supporting rollers 11, 12, and 13.

Figure 9:
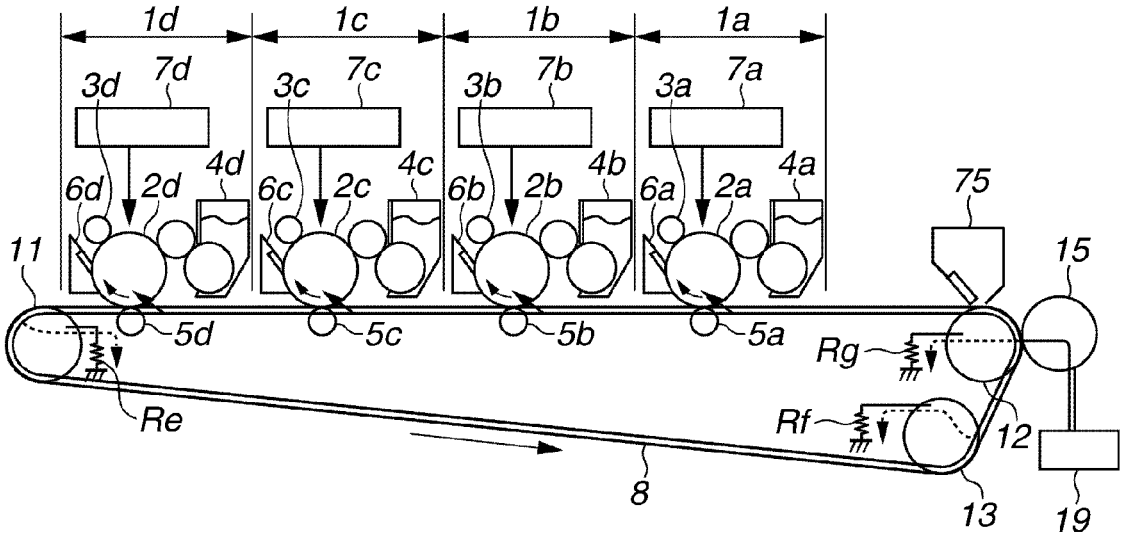
FIG. 9 is a sectional view schematically illustrating a current flowing in the rotational direction of the intermediate transfer belt.

FIG. 9 schematically illustrates a current flowing from the secondary transfer roller 15 to the intermediate transfer belt 8. Referring to FIG. 9, the resistors Re, Rf, and Rg are connected to the supporting rollers 11, 12, and 13, respectively. Arrows with a thick solid line indicate currents flowing from the transfer power supply 19 to the photosensitive drums 2*a*, 2*b*, 2*c*, and 2*d*. Arrows with a thick dashed line indicate currents flowing into the supporting rollers 11, 12, and 13. As mentioned above, these currents increase with decreasing resistance values Re, Rg, and Rf. Since the image forming units 1*a*, 1*b* 1*c*, and 1*d* have almost the same potential difference between respective photosensitive drum and the intermediate transfer belt 8, almost the same current flows into the photosensitive drums 2*a*, 2*b*, 2*c*, and 2*d*. However, variation in thickness of the photosensitive layer on the photosensitive drums 2*a*, 2*b*, 2*c*, and 2*d* of the image forming units 1*a*, 1*b*, 1*c*, ad 1*d* causes variation in capacitance possibly resulting in variation in current flowing into respective photosensitive drums. In the present exemplary embodiment, the thickness of the photosensitive layer is 10 μm to 20 μm after the sheet-passing duration.

When the primary transfer section is sufficiently separated from the secondary transfer section, a transfer voltage most suitable for primary transfer is applied, as required, to the secondary transfer roller 15 at the time of primary transfer. When primary transfer is completed and then the secondary transfer timing is reached, a transfer voltage most suitable for secondary transfer may be selected.

The transfer power supply 19 may apply a voltage to the counter roller 12, not to the secondary transfer roller 15. In this case, the counter roller 12 serves as a current supply member. At the timing of secondary transfer after primary transfer, if the transfer power supply 19 applies to the counter roller 12 a voltage having the same polarity as the regular toner charging polarity, secondary transfer can be achieved.

Only one resistor may be connected for all of the supporting members 11, 12, and 13. The use of one resistor enables reducing the number of resistors. Since the supporting members 11, 12, and 13 are grounded via one common resistor, it becomes easier to maintain the surface potential of the intermediate transfer belt 8 to an equal potential.

The surface potential of the intermediate transfer belt 8 has specifically been described above based on a case where a transfer material is not present at the secondary transfer section. However, when simultaneously performing primary and secondary transfer, i.e., performing secondary transfer onto the (n−1)-th sheet during primary transfer onto the n-th sheet, for example, at the time of continuous image formation, it is necessary to taken into consideration a case where a transfer material is present at the secondary transfer section.

The surface potential of the intermediate transfer belt 8 when a transfer material is passing through the secondary transfer section will be described below. For elements equivalent to those described in the first exemplary embodiment, such as the configuration of the image forming apparatus, duplicated explanations will be omitted.

FIG. 5B illustrates a method for measuring the surface potential of the intermediate transfer belt 8 while a transfer material P is passing through the secondary transfer section. The method in FIG. 5B differs from the method in FIG. 5A only in that the transfer material P is present at the secondary transfer section.

Figure 10A:
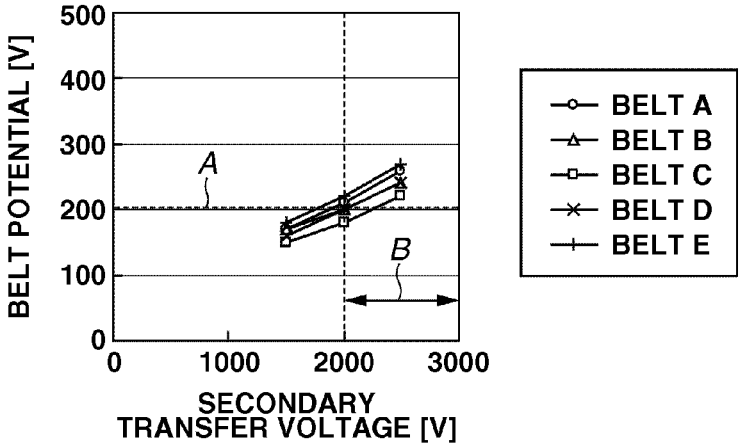
FIGS. 10A to 10C are graphs illustrating a relation between a potential measurement result for the intermediate transfer belt and the secondary transfer voltage when a transfer material is passing through a secondary transfer section.
Figure 10B:
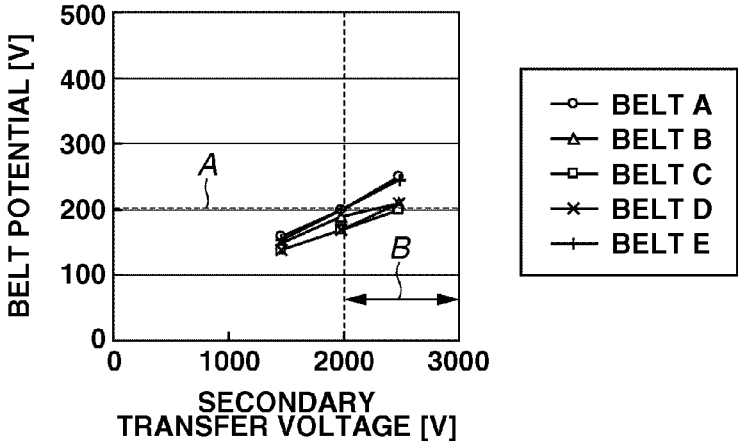
Figure 10C:
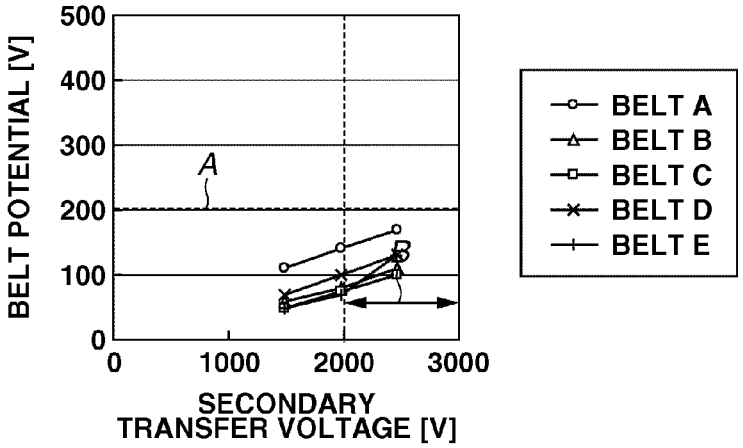

FIGS. 10A to 10C illustrate surface potential measurement results for the belts A to E when a transfer material is present at the secondary transfer section. FIGS. 10A, 10B, and 10C indicate measurement results when a resistor with a resistance of 1 GΩ, 100 MΩ, and 10 MΩ is used, respectively. Referring to FIGS. 10A to 10C, a dotted line A indicates the potential of the intermediate transfer belt 8 necessary to perform primary transfer, and a range B indicates a secondary transfer setting range. When comparing measurement results in FIGS. 8A to 8C with those in FIGS. 10A to 10C, the potential of the intermediate transfer belt 8 is slightly lower than that when a transfer material is present. This is because the voltage supplied from the transfer power supply 19 causes voltage drop by the transfer material at the secondary transfer section.

Referring to the comparison between FIGS. 8A to 8C and FIGS. 10A to 10C, when simultaneously performing primary and secondary transfer, i.e., performing secondary transfer onto the (n−1)-th sheet during primary transfer onto the n-th sheet, for example, at the time of continuous image formation, failure to take into consideration the voltage drop by the transfer material at the secondary transfer section may cause the supplied voltage to be unable to maintain the surface potential of the intermediate transfer belt 8. Specifically in this case, the primary transfer performance maybe degraded when secondary transfer is started.

Although a large resistance of each resistor enables maintaining a high surface potential of the intermediate transfer belt 8, too large a resistance makes it necessary to increase the applied voltage. In this case, a power supply having a larger capacity will be required. Further, too high a secondary transfer voltage may degrade the secondary transfer performance depending on the type of transfer material. More specifically, a high secondary transfer voltage causes electrical discharge to invert the toner charge characteristics, degrading the secondary transfer performance.

In the present exemplary embodiment, therefore, a resistor having a resistance of about 100 MΩ to 1 GΩ is connected to each of the supporting rollers 11, 12, and 13 to maintain the surface potential of the intermediate transfer belt 8 to the predetermined potential (200 V).

When a transfer material is present at the secondary transfer section, it is necessary to change the voltage required for performing secondary transfer to cope mainly with resistance variation on a transfer material. For example, under 30° C. and 80% environmental conditions, the secondary transfer voltage required for secondary transfer is 1 kV. Under 15° C. and 5% environmental conditions, the secondary transfer voltage required for secondary transfer is 3.5 kV. Using resistors with a resistance of 1 GΩ to 100 MΩ to cope with variation in secondary transfer voltage due to such environmental variation enables maintaining the surface potential of the intermediate transfer belt 8 to the predetermined potential or higher, thus simultaneously achieving primary and secondary transfer.

Although, in the present exemplary embodiment, resistors with a resistance of 100 MΩ to 1 GΩ are used, constant voltage elements may be connected and grounded instead of resistors.

Figure 11:
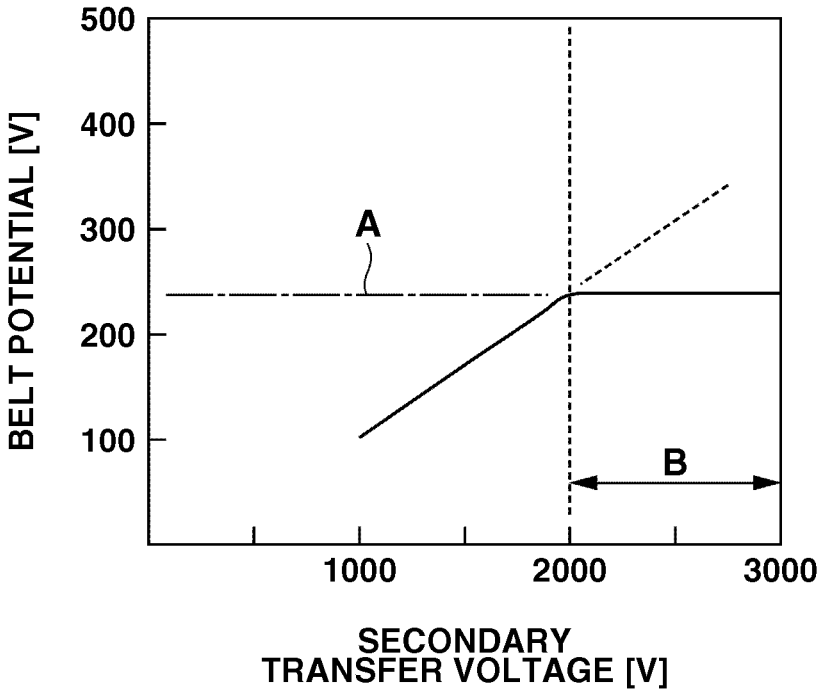
FIG. 11 is a graph illustrating an effect of constant voltage elements according to exemplary embodiments of the present invention.
Figure 12A:
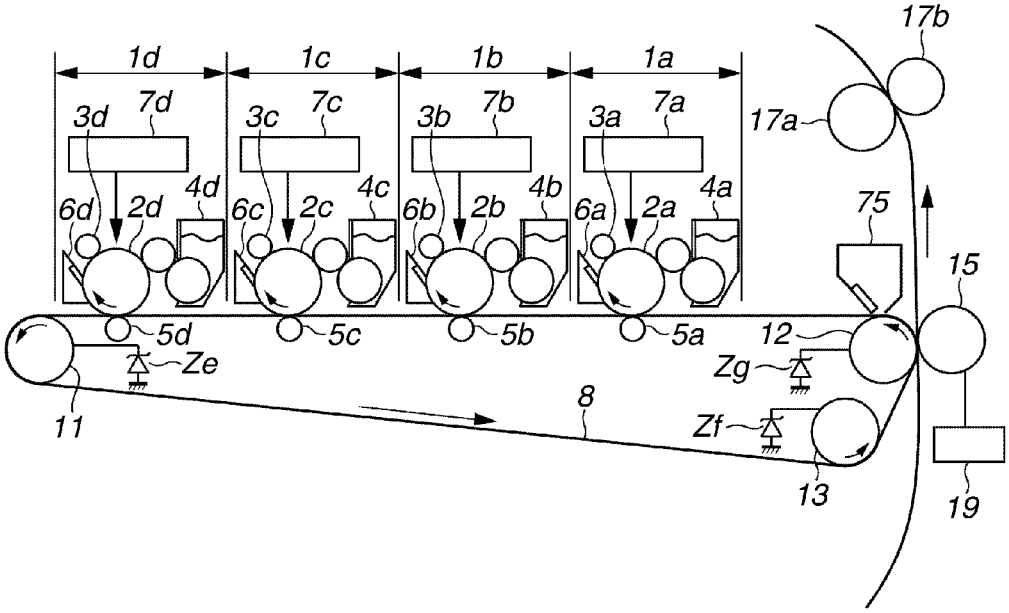
FIGS. 12A and 12B are sectional views schematically illustrating a state where a Zener diode or varistor is connected to each supporting member.
Figure 12B:
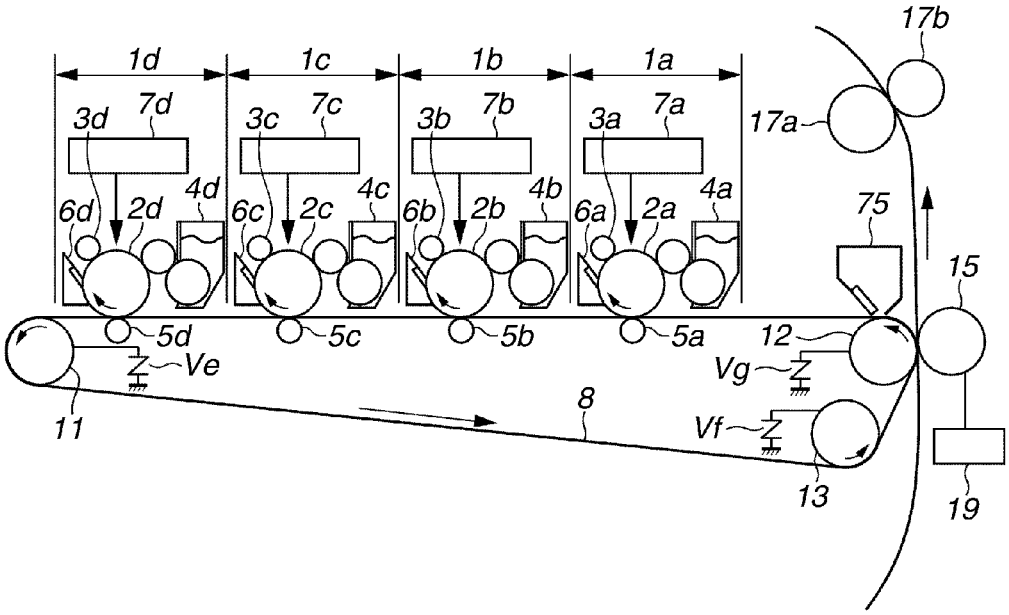

FIG. 11 illustrates a relation between the secondary transfer voltage and the potential of the intermediate transfer belt 8 when a constant voltage element (for example, a Zener diode or varistor) is connected to each of the supporting members 11, 12, and 13. Referring to FIG. 11, a dashed-dotted line A indicates a Zener diode potential or varistor potential, and a range B indicates a secondary transfer setting range. FIG. 12A illustrates a state where a Zener diode is connected to each of the supporting members 11, 12, and 13. FIG. 12B illustrates a state where a varistor is connected to each of the supporting members 11, 12, and 13.

In the case of resistors, the potential of the intermediate transfer belt 8 increases with increasing secondary transfer voltage. In the case of Zener diodes or varistors, however, when the potential of the intermediate transfer belt 8 exceeds the Zener diode potential or varistor potential, a current flows maintaining the Zener diode potential or varistor potential. Therefore, even if the secondary transfer voltage is raised, the potential of the intermediate transfer belt 8 does not reach the Zener diode potential or varistor potential. Thus, since the potential of the intermediate transfer belt 8 can be maintained constant, the primary transfer performance can be maintained more stably. Further, since the secondary transfer voltage setting range increases, the degree of freedom of the secondary transfer voltage setting increases accordingly.

In the present exemplary embodiment, it is useful to set the Zener diode potential or varistor potential to 220 V in consideration of environmental effects.

The thus-configured Zener potential or varistor potential enables independently optimizing the secondary transfer setting and primary transfer while stably maintaining the primary transfer performance. (Since the surface potential of the intermediate transfer belt 8 for primary transfer can be determined by the Zener diode potential or varistor potential, the range of the secondary transfer voltage setting increases.)

Thus, the configuration of the present exemplary embodiment uses a conductive intermediate transfer belt 8; connects to each supporting member a resistor having a predetermined resistance or higher, or a Zener diode or varistor maintaining a predetermined potential or higher; and applies a voltage from the transfer power supply 19. This configuration enables maintaining the surface potential of the intermediate transfer belt 8 to the predetermined potential or higher regardless of the resistance of a transfer material, thus achieving primary and secondary transfer at the same timing.

Figure 13A:
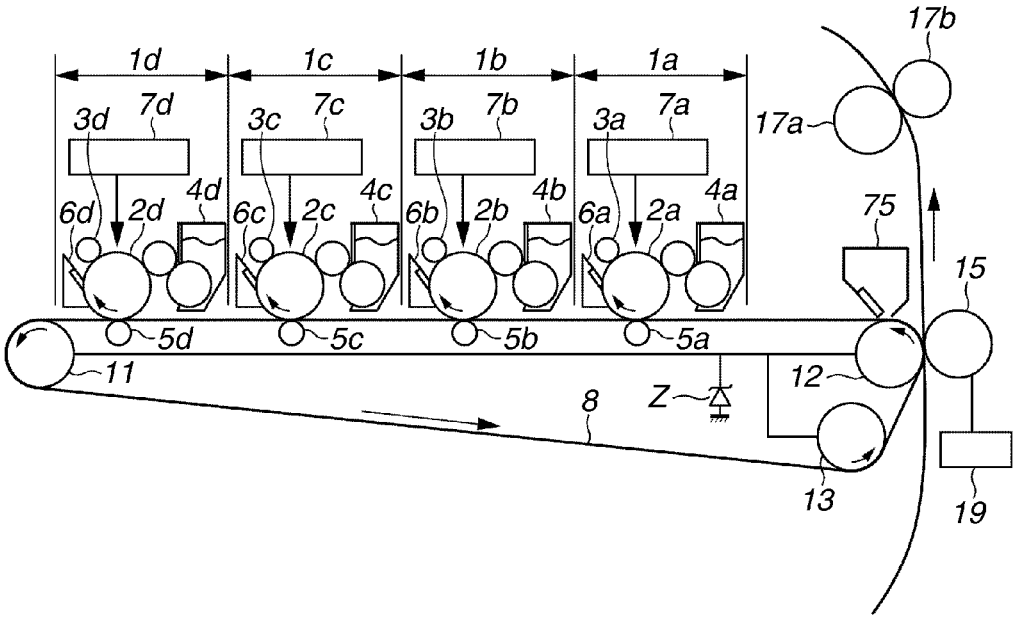
FIGS. 13A and 13B are sectional views schematically illustrating a state where a common Zener diode or a common varistor is connected to the supporting members.
Figure 13B:
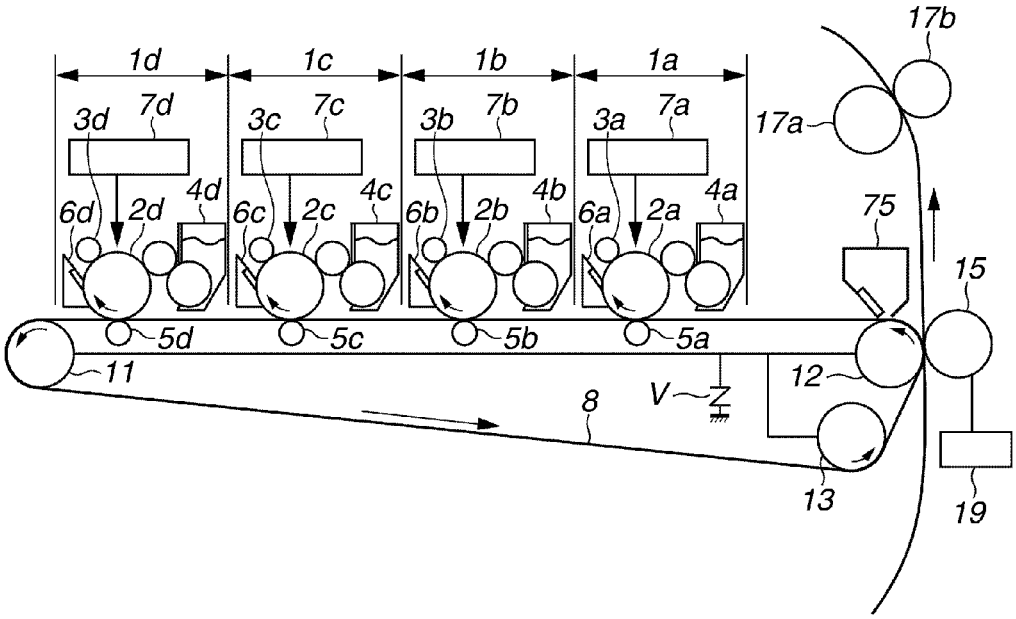

As illustrated in FIGS. 13A and 13B, a common constant voltage element (Zener diode or varistor) may be connected to all of the supporting rollers 11, 12, and 13. The use of such a common element enables reducing the number of constant voltage elements.

Figure 14A:
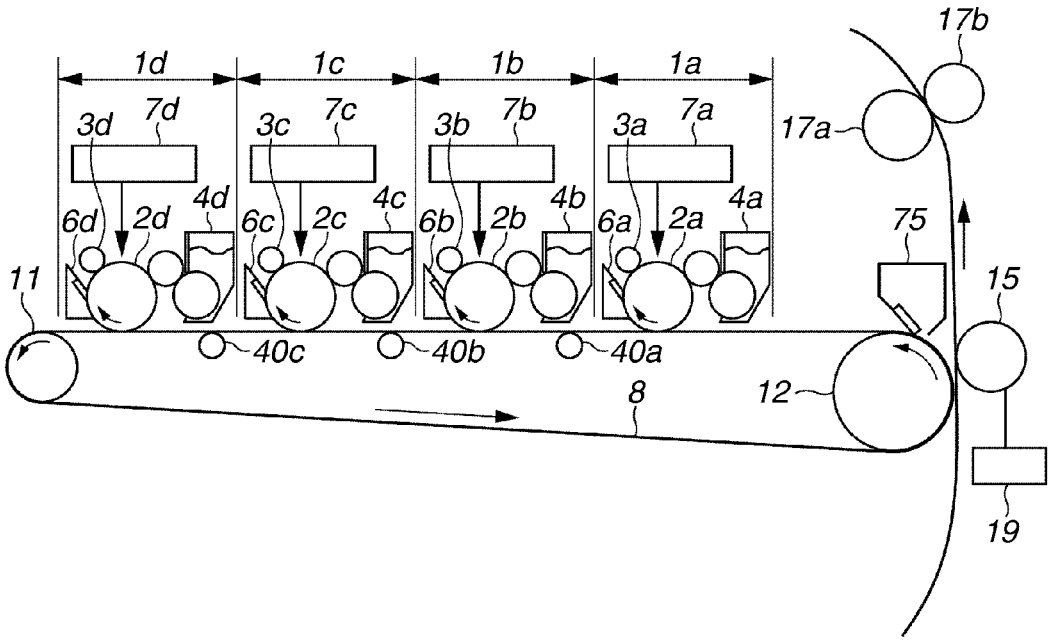
FIGS. 14A and 14B are sectional views schematically illustrating an image forming apparatus having another configuration applicable to the present invention.
Figure 14B:
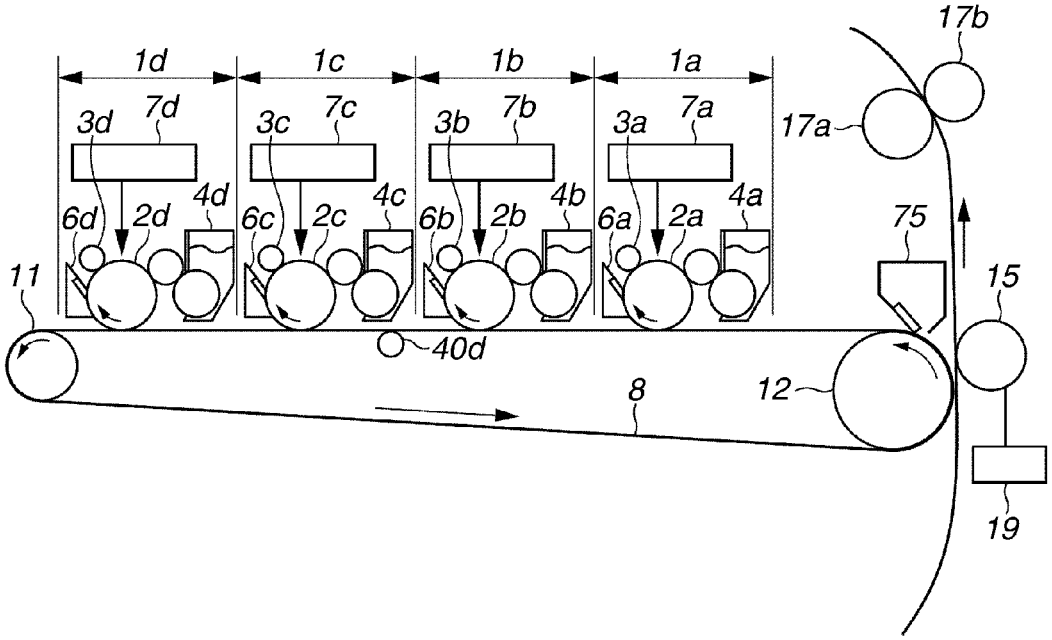

The above-mentioned first and second exemplary embodiments may be modified to the following configurations. As illustrated in FIGS. 14A and 14B, the number of supporting rollers for supporting the intermediate transfer belt 8 may be reduced to two to further downsize the image forming apparatus.

Further, as illustrated in FIGS. 14A, 14B, 15, and 16, the counter members 5*a* to 5*d* may be removed. These counter members form the primary transfer sections with respective photosensitive drums via the intermediate transfer belt 8. Possible configurations with which the primary transfer sections can be formed without using the counter members 5*a* to 5*d* will specifically be described below. FIG. 14A illustrates a configuration with which primary transfer rollers 40*a*, 40*b*, and 40*c* are arranged between the photosensitive drums 2*a* and 2*b*, between the photosensitive drums 2*b* and 2*c*, and between the photosensitive drums 2*c* and 2*d*, respectively, on the inner surface of the intermediate transfer belt 8 to raise the intermediate transfer belt 8 toward the photosensitive drums 2*a*, 2*b*, 2*c*, and 2*d*. FIG. 14B illustrates another configuration with which only one primary transfer roller 40*d* is arranged between the image forming unit 1*b* and 1*c*.

Figure 15:
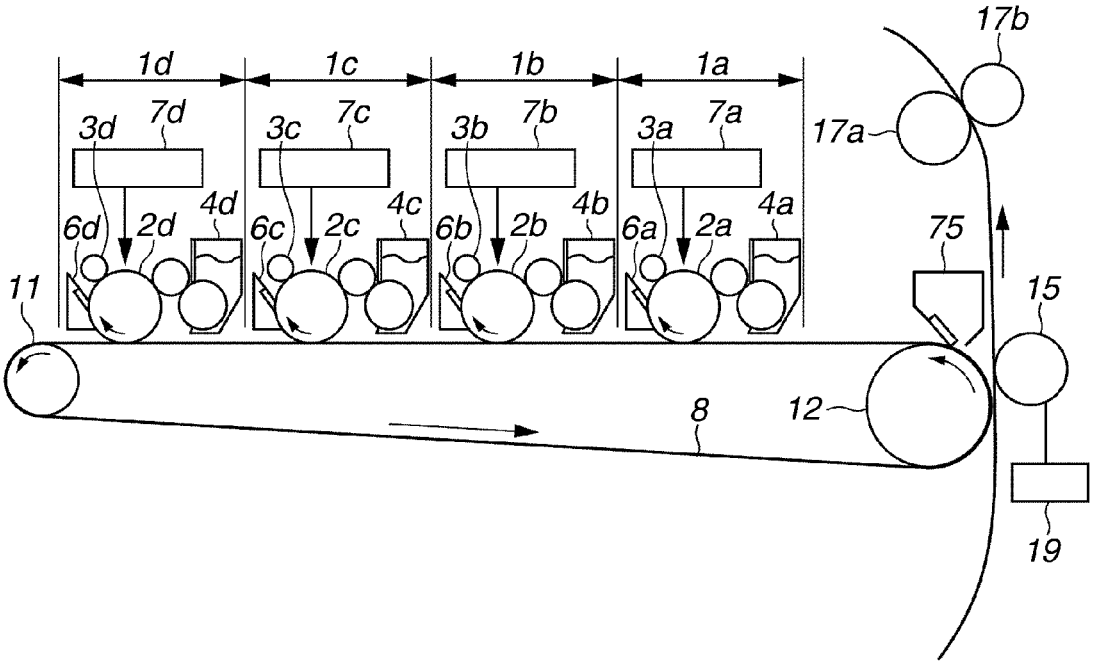
FIG. 15 is a sectional view schematically illustrating an image forming apparatus having still another configuration applicable to the present invention.

FIG. 15 illustrates still another configuration with which the intermediate transfer belt 8 contacts the photosensitive drums 2*a*, 2*b*, 2*c*, and 2*d* only by its tension. In this case, all of the primary transfer rollers 40*a*, 40*b*, 40*c*, and 40*d* may be removed. Specifically, the image forming units 1*a*, 1*b*, 1*c*, and 1*d* are slightly lowered below the primary transfer side surface of the intermediate transfer belt 8 formed by the secondary transfer counter roller 12 and the drive roller 11. In some cases, the photosensitive drums 2*a*, 2*b*, 2*c*, and 2*d* contact the intermediate transfer belt 8 more reliably by lowering the image forming units 1*b* and 1*c* more than the image forming units 1*a* and 1*d*.

Figure 16:
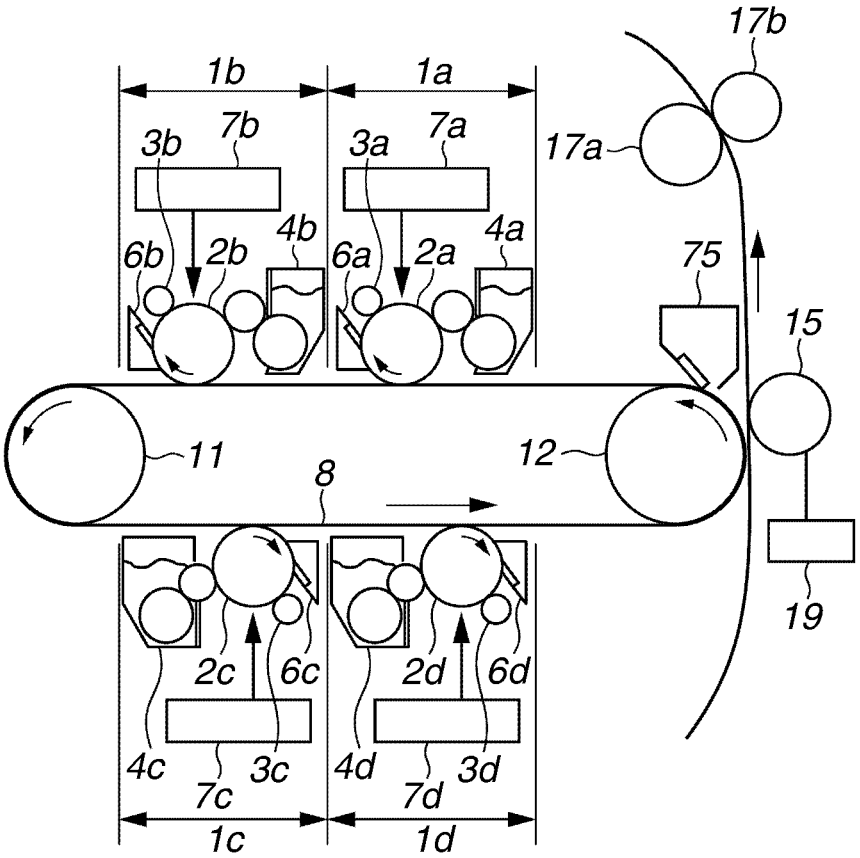
FIG. 16 is a sectional view schematically illustrating an image forming apparatus having still another configuration applicable to the present invention.

FIG. 16 illustrates still another configuration with which the image forming units 1*c* and 1*d* are arranged under the intermediate transfer belt 8. In this case, it is preferable to lower the image forming units 1*a* and 1*b* slightly below the surface of the intermediate transfer belt 8 and raise the image forming units 1*c* and 1*d* slightly above the surface of the intermediate transfer belt 8. In some cases, arranging the image forming unit 1*a*, 1*b*, 1*c*, and 1*d* in this way enables further downsizing the image forming apparatus.

The voltage supplied to the secondary transfer roller 15 may be based on constant voltage control, constant current control, or a combination of both, as long as the image forming apparatus can exhibit its full primary and secondary transfer performances.

Although, in the present exemplary embodiment, the intermediate transfer belt 8 is made of PPS containing additive carbon to provide electrical conductivity, the composition of the intermediate transfer belt 8 is not limited thereto. Even with other resins and metals, similar effects to those of the present exemplary embodiment can be expected as long as equivalent electrical conductivity is achieved. Although, in the present exemplary embodiment, single-layer and two-layer intermediate transfer belts are used, the layer configuration of the intermediate transfer belt 8 is not limited thereto. Even with a three-layer intermediate transfer belt including, for example, an elastic layer, similar effects to those of the present exemplary embodiment can be expected as long as the above-mentioned circumferential resistance is achieved.

Although, in the present exemplary embodiment, the intermediate transfer belt 8 having two layers is manufactured by forming a base layer first and then a coating layer thereon, the manufacture method is not limited thereto. For example, casting may be used as long as relevant resistance values satisfy the above-mentioned conditions.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-225218 filed Oct. 4, 2010, No. 2010-225219 filed Oct. 4, 2010, No. 2010-272695 filed Dec. 7, 2010, and No. 2011-212309 filed Sep. 28, 2011, which are hereby incorporated by reference herein in their entirety.

The invention claimed is:

1. An image forming apparatus comprising:

an image bearing member configured to bear a toner image;

a rotatable endless intermediate transfer member; and a power supply configured to apply a voltage for transferring the toner image which is on the image bearing member onto a transfer material via the intermediate transfer member, wherein the intermediate transfer member is provided with electrical conductivity, and wherein the power supply applies a transfer voltage that is in an opposite polarity to a regular toner charging polarity so as to perform a primary transfer that transfers a toner image from the image bearing member to the intermediate transfer member by flowing a current via the intermediate transfer member in circumferential direction of the intermediate transfer member, and the power supply applies the transfer voltage that is in the opposite polarity so as to perform a secondary transfer that transfers the toner image from the intermediate transfer member to the transfer material.

2. The image forming apparatus according to claim 1, further comprising:

a secondary transfer member in contact with the outer circumferential surface of the intermediate transfer member to form a secondary transfer section with the intermediate transfer member, and wherein the power supply applies the opposite polarity voltage to the secondary transfer member.

3. The image forming apparatus according to claim 2, wherein the power supply applies a voltage to the secondary transfer member to secondary transfer the toner image from the intermediate transfer member to the transfer material and, at the same time, to primary transfer the toner image from the image bearing member to the intermediate transfer member.

4. The image forming apparatus according to claim 1, wherein a first metal roller to which a measurement voltage is applied from a measurement power supply contacts the intermediate transfer member, wherein a second metal roller to which a current detection unit is connected contacts the intermediate transfer member at a position separated from the first metal roller in the rotational direction of the intermediate transfer member, wherein a value obtained by dividing the measurement voltage by a current value detected by the current detection unit is defined as a circumferential resistance of the intermediate transfer member, and wherein the value of the circumferential resistance of the intermediate transfer member is $10^4$ Ω or above and $10^8$ Ω or below.

5. The image forming apparatus according to claim 2, further comprising:

a plurality of supporting members, wherein the intermediate transfer member is an endless belt of which inner periphery thereof is supported by the plurality of supporting members.

6. The image forming apparatus according to claim 5, further comprising:

a resistor for maintaining a surface potential of the belt connected to one of the plurality of supporting members, wherein the one of the plurality of supporting members is a counter member facing the secondary transfer member via the belt.

7. The image forming apparatus according to claim 6, wherein the plurality of supporting members is connected to a common resistor.

8. The image forming apparatus according to claim 6, wherein, by being supplied with a current from the secondary transfer member to the resistor via the belt and the counter member, the belt surface maintains a potential that is equal to or more than a predetermined value.

9. The image forming apparatus according to claim 5, further comprising:

a constant voltage element for maintaining a surface potential of the belt connected to one of the plurality of supporting members, wherein the one of the plurality of supporting members is a counter member facing the secondary transfer member via the belt.

10. The image forming apparatus according to claim 9, wherein the plurality of supporting members is connected to a common constant voltage element.

11. The image forming apparatus according to claim 9, wherein, by being supplied with a current from the secondary transfer member to the constant voltage element via the belt and the counter member, the belt surface maintains a potential that is equal to or more than a predetermined value.

12. The image forming apparatus according to claim 9, wherein the constant voltage element is a Zener diode.

13. The image forming apparatus according to claim 9, wherein the constant voltage element is a varistor.

14. The image forming apparatus according to claim 5, wherein the belt has a multilayer configuration with a resistance of a surface layer higher than a resistance of other layers.

15. The image forming apparatus according to claim 1, wherein the image bearing member is a plurality of image bearing members bearing a different-color toner image respectively.

16. The image forming apparatus according to claim 15, wherein the plurality of image bearing members are provided with a plurality of pressing members at positions where corresponding thereof via the intermediate transfer member, and wherein the intermediate transfer member and the plurality of image bearing members contact with each other with the plurality of pressing members.

17. An image forming apparatus comprising:

an image bearing member configured to bear a toner image;

a rotatable endless intermediate transfer member;

a current supply member contacting an outer periphery of the intermediate transfer member and configured to supply a current to the intermediate transfer member; and a power supply configured to apply a voltage to the current supply member, wherein the intermediate transfer member is provided with electrical conductivity, and wherein, by being applied with a voltage from the power supply, the current supply member performs a primary transfer that transfers a toner image from the image bearing member to the intermediate transfer member by flowing a current via the intermediate transfer member in circumferential direction of the intermediate transfer member, and perform a secondary transfer that transfers the toner image from the intermediate transfer member to the transfer material by being applied with a voltage from the power supply.

18. The image forming apparatus according to claim 17, further comprising:

a counter member contacting an inner periphery of the intermediate transfer member and facing the current supply member, wherein the current supply member forms a secondary transfer section with the intermediate transfer member.

19. The image forming apparatus according to claim 18, wherein the power supply applies a voltage having an opposite polarity of a regular toner charging polarity to the current supply member.

20. The image forming apparatus according to claim 18, wherein the power supply applies a voltage to the current supply member to primarily transfer the toner images from the image bearing members to the intermediate transfer member and, at the same time, to secondarily transfer the toner images from the intermediate transfer member onto the transfer material.

21. The image forming apparatus according to claim 17, wherein a first metal roller to which a measurement voltage is applied from a measurement power supply contacts the intermediate transfer member, wherein a second metal roller to which a current detection unit is connected contacts the intermediate transfer member at a position separated from the first metal roller in the rotational direction of the intermediate transfer member, wherein a value obtained by dividing the measurement voltage by a current value detected by the current detection unit is defined as a circumferential resistance of the intermediate transfer member, and wherein the value of the circumferential resistance of the intermediate transfer member is $10^4$ Ω or above and $10^8$ Ω or below.

22. The image forming apparatus according to claim 18, further comprising:

a resistor connected to the counter member and configured to maintain a surface potential of the intermediate transfer member.

23. The image forming apparatus according to claim 22, wherein, by being supplied with a current from the current supply member to the resistor via the intermediate transfer member and the counter member, potential of surface of the intermediate transfer member is maintained in a potential equal to or more than a predetermined value.

24. The image forming apparatus according to claim 23, further comprising:

a supporting member configured to support an inner periphery of the intermediate transfer member, wherein the intermediate transfer member is an intermediate transfer belt of which inner periphery thereof is supported by the supporting member.

25. The image forming apparatus according to claim 24, wherein the supporting member is connected to the resistor which is shared with the counter member.

26. The image forming apparatus according to claim 18, further comprising:

a constant voltage element connected to the counter member and configured to maintain a surface potential of the intermediate transfer member.

27. The image forming apparatus according to claim 26, wherein, by being supplied with a current from the current supply member to the constant voltage element via the intermediate transfer member and the counter member, the surface of the intermediate transfer member maintains a potential that is equal to or more than a predetermined value.

28. The image forming apparatus according to claim 27, further comprising:

a supporting member configured to support an inner periphery of the intermediate transfer member, wherein the intermediate transfer member is an intermediate transfer belt of which inner periphery thereof is supported by the counter member and the supporting member.

29. The image forming apparatus according to claim 28, wherein the supporting member is connected to the constant voltage element which is shared with the counter member.

30. The image forming apparatus according to claim 26, wherein the constant voltage element is a varistor.

31. The image forming apparatus according to claim 26, wherein the constant voltage element is a Zener diode.

32. The image forming apparatus according to claim 17, wherein the image bearing member is a plurality of image bearing members bearing a different-color toner image respectively.

33. The image forming apparatus according to claim 32, wherein the plurality of image bearing members are provided with a plurality of pressing members at positions where corresponding thereof via the intermediate transfer member, and wherein the intermediate transfer member and the plurality of image bearing members contact with each other with the plurality of pressing members.

34. The image forming apparatus according to claim 17, wherein the intermediate transfer member has a multilayer configuration with a resistance of a surface layer higher than a resistance of other layers.

* * * * *